US008726418B2

(12) United States Patent
DeBlasis et al.

(10) Patent No.: US 8,726,418 B2
(45) Date of Patent: May 20, 2014

(54) ADJUSTABLE GLOVE

(75) Inventors: Thomas DeBlasis, Portland, OR (US); Todd Smith, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 1240 days.

(21) Appl. No.: 12/105,144

(22) Filed: Apr. 17, 2008

(65) Prior Publication Data

US 2008/0263747 A1 Oct. 30, 2008

Related U.S. Application Data

(60) Provisional application No. 60/914,955, filed on Apr. 30, 2007.

(51) Int. Cl.
*A41D 19/00* (2006.01)

(52) U.S. Cl.
USPC ..... 2/161.1

(58) Field of Classification Search
USPC ..... 2/16, 18, 19, 159, 160, 161.2, 161.3, 2/161.4, 161.5, 161.6, 161.8, 162, 170
See application file for complete search history.

(56) References Cited

U.S. PATENT DOCUMENTS

| | | | | |
|---|---|---|---|---|
| 3,372,401 | A | | 3/1968 | Woodward |
| 3,944,220 | A | | 3/1976 | Fasano |
| 4,042,977 | A | | 8/1977 | Antonious |
| 4,658,445 | A | | 4/1987 | Tribble |
| 4,701,963 | A | | 10/1987 | Overton |
| 4,843,651 | A | * | 7/1989 | Gramza et al. ..... 2/161.1 |
| 5,004,227 | A | * | 4/1991 | Hoffman ..... 482/105 |
| 5,195,188 | A | | 3/1993 | Bourdeau et al. |
| 5,197,149 | A | | 3/1993 | Overton |
| 5,224,220 | A | | 7/1993 | Andriola |
| 5,367,712 | A | | 11/1994 | Smith et al. |
| 5,409,447 | A | | 4/1995 | Wedge, Jr. |
| 5,513,391 | A | | 5/1996 | Garneau et al. |
| 5,697,103 | A | | 12/1997 | Wiggins |
| 5,706,521 | A | * | 1/1998 | Haney ..... 2/160 |
| 5,740,555 | A | | 4/1998 | Renegar |
| 5,765,228 | A | | 6/1998 | Bieling |
| 5,867,830 | A | | 2/1999 | Chen |

(Continued)

FOREIGN PATENT DOCUMENTS

| | | |
|---|---|---|
| GB | 2 281 020 | 2/1995 |
| JP | 2003334272 | 11/2003 |
| JP | 2007031921 | 8/2007 |

OTHER PUBLICATIONS

Chinese Office Action mailed Oct. 13, 2010 in Chinese Application No. CN200880014161.9.

(Continued)

*Primary Examiner* — Khoa Huynh
*Assistant Examiner* — Anna Kinsaul
(74) *Attorney, Agent, or Firm* — Plumsea Law Group, LLC

(57) ABSTRACT

A glove for use by a soccer goalie includes several adjustment mechanisms, such as straps. The straps allow the glove to be adjusted for fit, such as by manipulating the width of the glove across the palm or the size of the wrist opening. Additionally, the glove includes a pull tab that allows the wearer to adjust the position of the fingers of the hand within the glove quickly so that the webs of the fingers remain in contact with the inside of the glove at the bases of the finger stalls.

21 Claims, 17 Drawing Sheets

(56) References Cited

U.S. PATENT DOCUMENTS

| | | | | |
|---|---|---|---|---|
| 6,286,148 | B1 | 9/2001 | Meyer | |
| 6,341,376 | B1 | 1/2002 | Smerdon, Jr. | |
| 6,526,592 | B1 | 3/2003 | Best | |
| 6,938,274 | B2 | 9/2005 | Addington et al. | |
| 6,990,689 | B1 | 1/2006 | Thellmann | |
| 7,607,178 | B2 * | 10/2009 | DeBlasis | 2/21 |
| 2007/0022513 | A1 | 2/2007 | Avis et al. | |
| 2009/0100573 | A1 * | 4/2009 | Coulter et al. | 2/161.1 |

OTHER PUBLICATIONS

International Search Report and Written Opinion, mailed Oct. 30, 2008, from PCT Application No. PCT/US2008/061975.

Japanese Office Action mailed Jan. 5, 2012 in Japanese Application No. JP 2010-506595.

Notification Concerning Transmittal of International Preliminary Report on Patentability, mailed Nov. 12, 2009, from PCT Application No. PCT/US2008/061975.

Chinese Office Action mailed May 11, 2011 in Chinese Application No. CN200880014161.9.

Chinese Office Action mailed Sep. 6, 2011 in Chinese Application No. CN200880014161.9.

Chinese Office Action mailed Mar. 20, 2012 in Chinese Application No. CN200880014161.9.

Chinese Office Action mailed Aug. 31, 2012 in Chinese Application No. CN200880014161.9.

* cited by examiner

ADJUSTABLE GLOVE

CROSS REFERENCE TO RELATED APPLICATION

This application claims the benefit under 35 U.S.C. 119(e) to application Ser. No. 60/914,955 titled "Adjustable Glove" and filed on Apr. 30, 2007, the entirety of which is incorporated herein by reference.

BACKGROUND OF THE INVENTION

1. Field of the Invention

The present invention relates generally to an athletic glove. More particularly, the invention relates to a size adjustable glove capable of being re-positioned readily during play.

2. Description of Related Art

Goalkeepers on soccer teams, sometimes referred to as "goalies", often utilize gloves to protect their hands from the impact of soccer balls when the goalies catch, deflect, or punch the soccer balls. Goalie gloves are therefore made from a cushioning material, such as latex foam, which provides protection and the ability to grip a ball. These materials typically cover or substantially cover the palm side and dorsal side of the goalie's hands. The materials of goalie gloves, however, can be cumbersome, as the materials sacrifice flexibility in the service of impact protection.

The stiffness of the cushioning material of goalie's gloves, while providing protection to the goalie's hands, can yield several undesirable consequences. In particular, the gloves can move with respect to the goalie's hands during the course of a game, making the fit across the back of the hand and through the fingers poor. This slippage can be caused by movement of the hand, particularly the palm, within and with respect to the glove due to an insufficiently tight fit of the glove on the hand. Additionally, the glove may become wet during play, such as due to absorption of rain or perspiration. The latex foam of the goalie glove becomes heavy when wet, which causes the glove to tend to slip away from the wrist.

As the goalie gloves are stiff, adjusting the gloves rapidly across the back of the hand and through the fingers during a game can be challenging, particularly when both hands are gloved, as is typical. Furthermore, if the gloves are wetted, the gloves become even more cumbersome and difficult to adjust for a better fit across the back of the hand and through the fingers.

Attempts to address slippage of goalie gloves have been made by addressing the fit of the glove on the hand. For example, U.S. Pat. No. 5,867,830 discloses a goalie glove having an adjustable fastening strap on the wrist. Additionally, the glove includes a slot to relieve the stiffness of the palm side of the glove. However, the '830 glove does not include any features for quickly readjusting the fit of the glove, nor does the '830 glove attempt to address the fit of the glove across the palm.

UK patent application number 9413647.0 discloses a goalie glove that includes woven textile material extending from the wristband toward the center of the glove. A securing strap is also provided to help cinch the glove around the hand. The woven material is more flexible than the rest of the goalie glove, allowing the strapping system to conform the glove to the anatomy of the goalie's hand for a secure fit. However, the '647.0 glove does not include any features for quickly readjusting the fit of the glove should the glove slip.

Therefore, there exists a need in the art for a protective glove that addresses the fit of the glove on the hand and the need to adjust the glove quickly if the glove were to become misaligned on the hand.

SUMMARY OF THE INVENTION

A glove configured to allow a wearer to adjust the fit of the glove across the back of the hand and through the fingers is disclosed.

In one aspect, the invention provides a glove configured to receive a hand having a palm side, a dorsal side, fingers, and a wrist, the glove comprising a palm layer sized and shaped to substantially cover the palm side of the hand, a dorsal layer connected to the first layer, the dorsal layer sized and shaped to substantially cover at least a finger portion of the dorsal side of the hand, the dorsal layer being attached to the palm layer along a periphery in the finger portion and having a free end, and an adjustment system configured to position a web of the hand against an inside surface of the glove when manipulated.

In another aspect, the invention provides an adjustable glove configured to receive a hand having a palm side, a dorsal side, fingers, and a wrist, the adjustable glove comprising a first layer sized and shaped to substantially cover the palm side of the hand, a second layer connected to the first layer, the second layer sized and shaped to substantially cover at least a finger portion of the dorsal side of the hand, the second layer being attached to the first layer along a periphery in the finger portion and having a free end, a pull tab connected to the free end of the second layer, wherein pulling the pull tab toward the wrist positions a web of the hand against an inside surface of the glove, a third layer connected to and positioned between the first layer and the second layer, and a width adjustment strap connected to a first side of the third layer, the width adjustment strap being removably attachable to the third layer, wherein the width adjustment strap cinches the glove to the hand.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
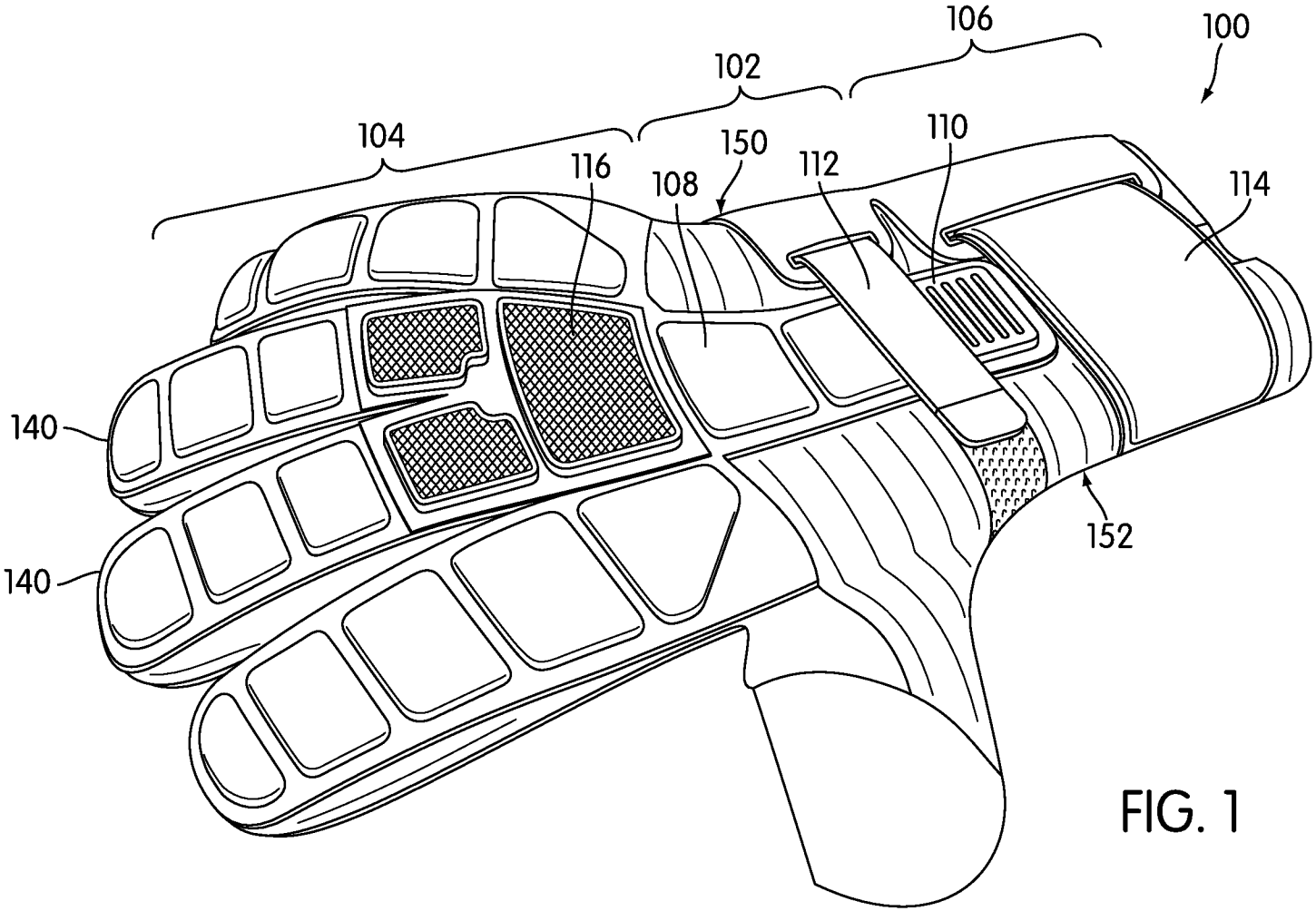
FIG. 1 is a side perspective view of a preferred embodiment of an adjustable goalie glove according to the invention with adjustment straps in a closed position.

FIG. 1 is a perspective view of a glove 100 according to an embodiment of the invention. Glove 100 is preferably used as a goalie glove for a soccer goalie. However, glove 100 may also be used in other athletic events. Further, the adjustment features of glove 100 may be adapted for use in gloves for general usage, such as winter weather gloves. While only a right hand glove is shown and discussed, it should be understood that glove 100 may be provided as a pair of gloves, with the left hand glove being formed as a mirror image of glove 100.

Glove 100 generally includes three sections, a main body 102, a finger portion 104 extending from a first side of main body 102, and a wrist portion 106 extending from the opposite side of main body 102. Glove 100 is also preferably provided with several adjustment straps: a width adjustment strap 112 for conforming main portion 102 of glove 100 to the wearer's hand, a wrist adjustment strap 114 for altering the size of the wrist opening of wrist portion 106, and a pull tab 108 for aligning the finger portion 104 with the fingers of the wearer's hand. Each of these adjustment straps is described in greater detail below.

Glove 100 is sized and shaped to receive a hand of a wearer. Preferably, finger portion 104 includes individual finger stalls 137 so that each finger of the wearer is inserted into a corresponding finger stall 140. However, in other embodiments, finger portion 104 may be configured so that multiple fingers are inserted into the same finger stall, or glove 100 may be a mitten-type hand covering with all fingers except for the thumb inserted into the same finger stall.

Figure 2:
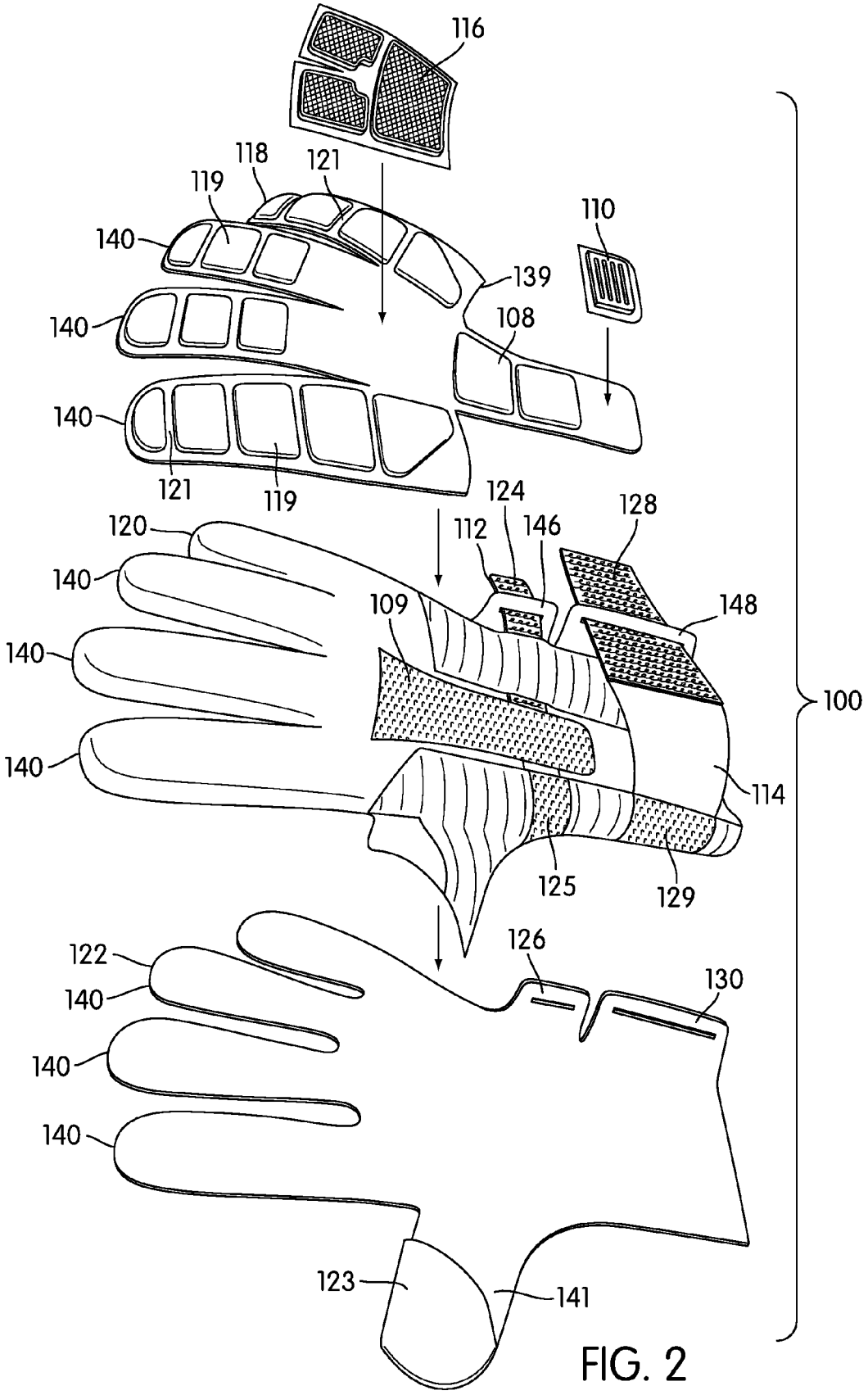
FIG. 2 is an exploded view of the glove of FIG. 1.

FIG. 2 is an exploded view showing the various components of glove 100. Glove 100 is preferably made from multiple layers attached together using any method known in the art, such as by stitching or with an adhesive. In a preferred embodiment, glove 100 is formed of three layers connected to each other at least in finger portion 104 (shown in FIG. 1): a dorsal layer 118, a flexible layer 120, and a palm layer 122. Dorsal layer 118 is preferably sized and shaped to cover finger portion 104 and at least a portion of main body 102 (shown in FIG. 1). Dorsal layer 118 is preferably the outermost layer of glove 100 on the dorsal side of the wearer's hand, although, preferably, dorsal layer 118 does not completely cover the dorsal side of the hand. However, in other embodiments, dorsal layer 118 may be extended toward wrist portion 106 (shown in FIG. 1) to substantially cover the dorsal side of the hand.

Dorsal layer 118 is preferably fixedly attached to palm layer 122 and flexible layer 120 around the periphery of finger stalls 137. A knuckle side edge 139 of dorsal layer 118 is preferably free and unattached to either flexible layer 120 or palm layer 122. Leaving dorsal layer 118 free from attachment to flexible layer allows for dorsal layer 118 to be manipulated independently of flexible layer 120 and palm layer 122.

Dorsal layer 118 is preferably made from a cushioning material, such as latex foam. The material for dorsal layer 118 is preferably thick to protect the fingers of the wearer from the impact of a ball. This thickness increases the stiffness of dorsal layer 118. Preferably, dorsal layer 118 is configured with a non-uniform thickness, with thick portions 119 for maximum protection separated by flexibility channels 121 that allow a wearer to more easily bend dorsal layer 118. Flexibility channels 121 are preferably thinned portions of dorsal layer 118. However, in other embodiments, dorsal layer 118 may be formed from multiple layers, with thick portions 119 attached to a thinner layer of material used to form flexibility channels 121. Preferably, however, dorsal layer 118 is formed from a single ply of material manufactured to provide the sections of differing thickness, thick portions 119 and flexibility channels 121. For example, dorsal layer 118 may be formed in a mold that provide the differing thicknesses, or dorsal layer 118 may be formed from a sheet of uniform thickness with flexibility channels 121 being cut into the sheet.

Dorsal layer 118 is preferably configured so that the main portion of dorsal layer 118 covers finger portion 104 of glove 100 with pull tab 108 extending away from finger portion 104 toward wrist portion 106. Pull tab 108 is preferably formed integrally with the remainder of dorsal layer 118, although pull tab 108 may be formed separately and affixed to the remainder of dorsal layer 118. Pull tab 108 is preferably made from the same material as the remainder of dorsal layer 118. However, pull tab 108 may alternatively be made from a different material, such as an inelastic woven material, a nonwoven material, or the like.

Figure 3:
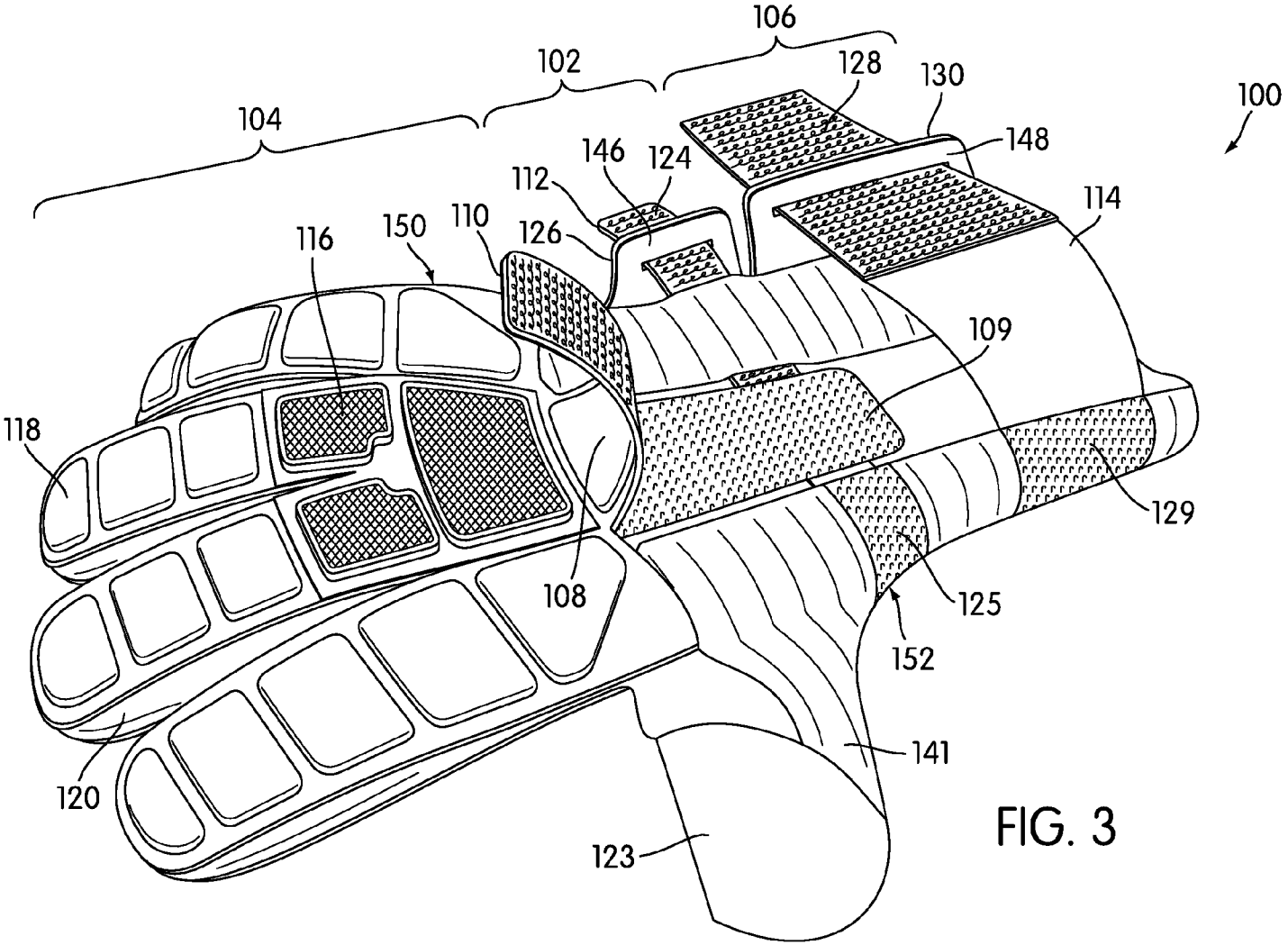
FIG. 3 is a perspective view of the glove of FIG. 1 with the adjustment straps in an open position.

Pull tab 108 preferably includes a securing mechanism so that pull tab 108 can be removably attached to flexible layer 120. While the securing mechanism may be any type of securing mechanism known in the art, such as snaps, buttons, or the like, the securing mechanism is preferably a hook and loop mechanism, such as Velcro®. As shown in FIGS. 2 and 3, securing portion 109 of the preferred hook-and-loop mechanism is affixed to flexible layer 120 using any method known in the art, such as by stitching or with an adhesive. The second portion of the securing mechanism (not shown) is affixed to pull tab 108. To secure pull tab 108 to flexible layer 120, pull tab 108 is pressed against securing portion 109 until the two portions of the securing mechanism engage. To remove pull tab 108 from flexible layer 120, pull tab 108 is peeled away from securing portion 109 to disengage the two portions of the securing mechanism.

Dorsal layer 118 also preferably and optionally includes two resilient portions: pull tab grip 110 and punch panel 116. Both pull tab grip 110 and punch panel 116 are preferably made from a durable material having a higher coefficient of friction than the material of dorsal layer 118. For example, pull tab grip 110 and punch panel 116 may be made from natural or synthetic rubber. Both pull tab grip 110 and punch panel 116 are preferably affixed to an outer surface of dorsal layer 118 using any method known in the art, such as by stitching or with an adhesive. Pull tab grip 110 provides a frictional surface for increased maneuverability of pull tab 108. Punch panel 116 provides a resilient surface on which the wearer may punch a ball with control while providing additional protection for the wearer's knuckles against the impact of the ball. Additionally, punch panel 116 also helps to reinforce dorsal panel 118 at the juncture where pull tab 108 extends away from dorsal panel 118. Both pull tab grip 110 and punch panel 116 may include surface texture, as shown, or may alternatively have smooth surfaces.

Palm layer 122 is preferably sized and shaped to cover the entire palm side of the wearer's hand as well as a portion of the wearer's wrist. Palm layer 122 provides a large, substantially planar surface to allow the wearer to more easily catch or deflect a ball. Additionally, to provide additional protection to the wearer's thumb, a portion 123 of palm layer 122 extends to cover the tip of a thumb stall 141. Having only a portion 123 of the stiffer material of palm layer 122 cover thumb stall 141 allows the thumb to maintain a fuller range of motion while still providing impact protection.

Figure 5:
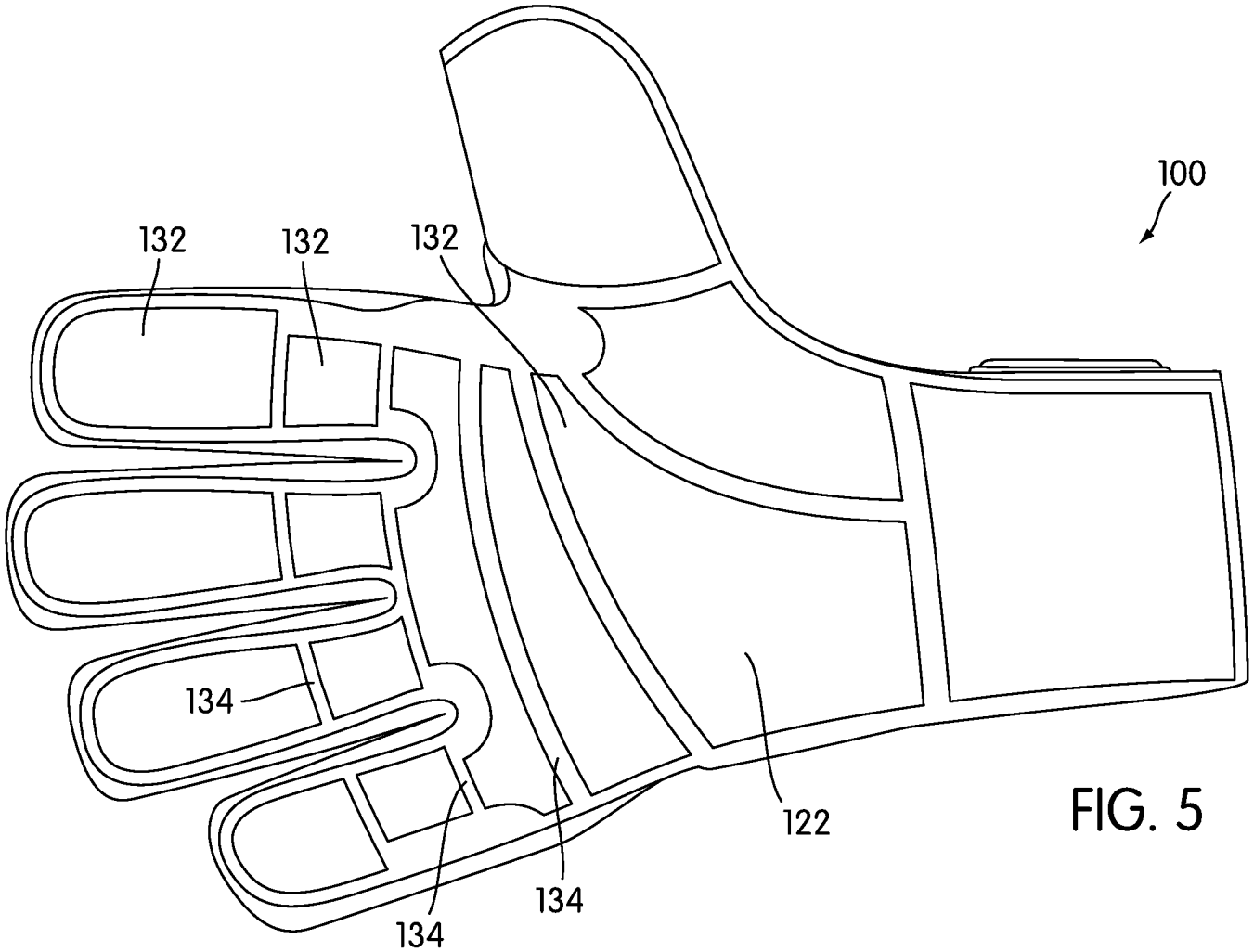
FIG. 5 is a palm view of the glove of FIG. 1.

Palm layer 122 is preferably formed from a single ply of a cushioning material similar to the material used for dorsal layer 118. Palm layer 122 may be attached directly to dorsal layer 118, but is preferably connected to dorsal layer 118 by flexible layer 120. As shown in FIG. 5, palm layer 122 also preferably includes thickened portions 132 that provide maximized cushioning and protection and flexibility channels 134 to reduce the stiffness of palm layer 122 for ease of bending of the hand and fingers. For example, palm layer 122 may be formed in a mold that provide the differing thicknesses, or palm layer 122 may be formed from a sheet of uniform thickness with flexibility channels 134 being cut into the sheet.

Flexible layer 120 is preferably sized and shaped to cover or substantially cover the wearer's hand. Flexible layer 120 preferably forms the sides of glove 100 to give glove 100 depth to accommodate the wearer's hand. Flexible layer 120 preferably forms the connection between dorsal layer 118 and palm layer 122, and is fixedly attached to both layers 118 and 122, such as by stitching or with an adhesive. Flexible layer 120 is preferably formed from a thin layer of a woven material, preferably including elastic fibers. For example, flexible layer 120 may be made from natural or synthetic elastic materials such as spandex, latex, neoprene, and rubber, natural or synthetic inelastic materials such as cotton, polyester, and nylon, blends of these materials, or the like. For comfort, flexible layer 120 is preferably an absorbent and breathable material.

Flexible layer 120 decreases the overall stiffness of glove 100, allowing the wearer to more easily flex and bend his or her hand within glove 100. Flexible layer 120 also reduces the weight of glove 100, which also increases the ability of the wearer's hand to maneuver glove 100. Therefore, flexible layer 120 helps to reduce fatigue over the course of a game, as the wearer's hand is not working as hard to manipulate glove 100 compared to a glove made entirely from the cushioning material of dorsal layer 118 and palm layer 122.

Figure 6:
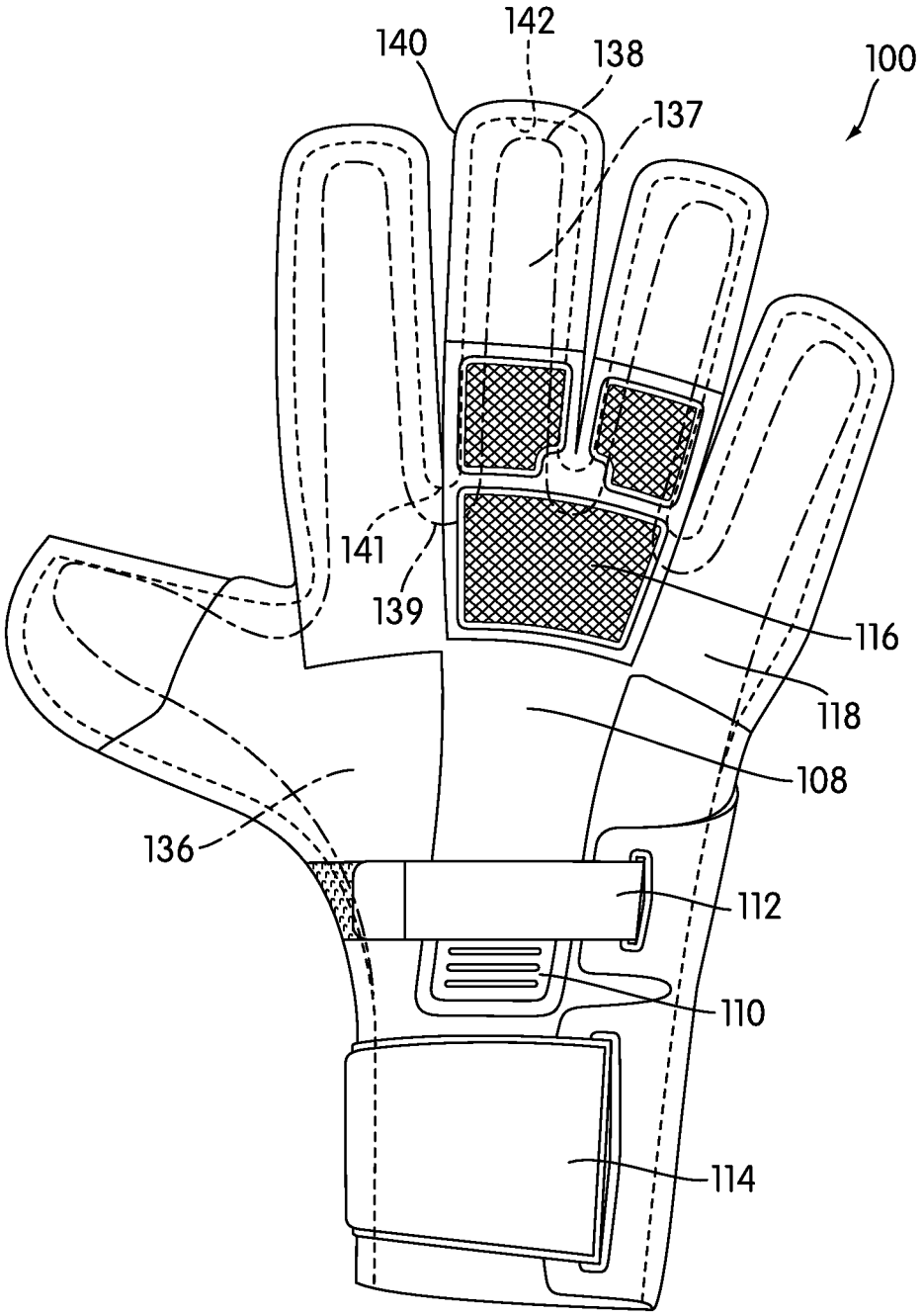
FIG. 6 is a top view showing a hand inserted into a glove according to the invention where the fingers are loosely positioned within the glove.
Figure 7:
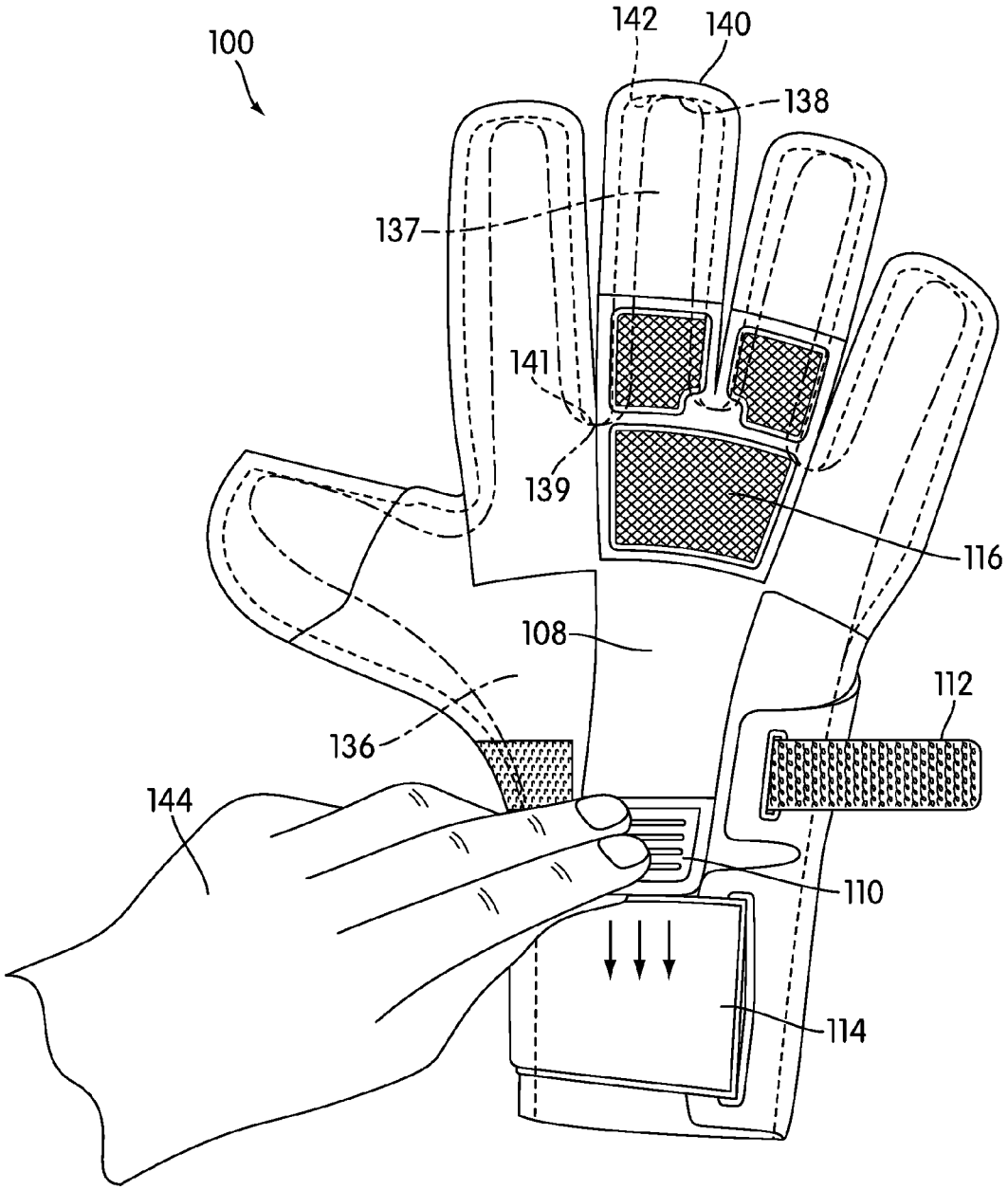
FIG. 7 is a top view showing an ungloved hand re-positioning the glove so that the fingers are tightly positioned within the glove.

Referring to FIGS. 6 and 7, the use of pull tab 110 to reposition glove 100 on a hand 136 is described. As shown in FIG. 6, during the course of a game, hand 136 and glove 100 may move relative to each other so that glove 100 is positioned loosely on hand 136. This shifting is often the result of slippage of hand 136 within glove 100 as hand 136 bends and flexes within glove 100, particularly if the fit of glove 100 on hand 136 is insufficiently tight.

A particular problem arises when a web 179 at the base of finger 137 of hand 136 becomes separated from an interior surface 181 at the base of a finger stall 140. It should be understood that while only one finger 137 is being discussed, this situation is equally applicable to any finger or all fingers of hand 136. Also, when web 179 becomes separated from interior surface 181, a fingertip 138 may become separated from an interior surface 142 at the tip of finger stall 140 or further separated from interior surface 142 if the fingers of hand 136 are too short to reach interior surface 142. The separation of web 179 from interior surface 181 makes manipulating the fingers of glove 100 difficult, as finger 137 is required to move all of the material of finger stall 140 when less than all of finger 137 is positioned within finger stall 140. Further, glove 100 may absorb moisture during the course of play, for example due to inclement weather or perspiration. As a result, glove 100 becomes heavy and difficult to maneuver effectively, both during play and while attempting to adjust glove 100 dorsal into the tightened position on hand 136.

As shown in FIG. 7, to reposition glove 100 on hand 136 so that web 179 is once again in contact with interior surface 181 of finger stall 140, pull tab 108 is grasped with a second hand 144. Width adjustment strap 112 may need to be disengaged from to free pull tab 108 if glove 100 is worn as shown in FIG. 1. This disengagement would be unnecessary if glove 100 is worn as shown FIG. 4. Second hand 144 may be ungloved as shown, or second hand 144 may be gloved with a glove similar to glove 100. While pull tab 108 may be grasped at any point along its length, preferably second hand 144 grasps pull tab grip 110 for optimum hold as the material of pull tab grip 110 provides a frictional surface. Pull tab 108 is lifted by second hand 144 to disengage pull tab 108 from flexible layer 120. Pull tab 108 is then drawn toward wrist adjustment strap 114, as shown by the arrows in FIG. 7. Moving pull tab 108 in this manner in turn pulls the entirety of dorsal layer 118 toward wrist adjustment strap 114. As dorsal layer 118 moves, dorsal layer 118 drags all of finger portion 104 dorsal into position. Pull tab 108 is drawn toward wrist adjustment strap 114 in this manner until web 179 is once again in contact with interior surface 181 of finger stall 140.

Adjusting glove 100 using pull tab 108 is more easily accomplished than if glove 100 had to be adjusted by pushing finger portion 104 or by attempting to pull glove 100 from wrist portion 106. Pull tab 108 and pull tab grip 110 provide a solid grip surface by which a heavy or wet glove 100 may be repositioned. This is particularly advantageous when second hand 144 is gloved. Additionally, as second hand 144 is pulling only on dorsal layer 118 and not on the entirety of glove 100 as dorsal layer 118 is partially unattached to glove 100, the added weight of a wet glove 100 does not hinder the manipulation of glove 100.

Figure 8:
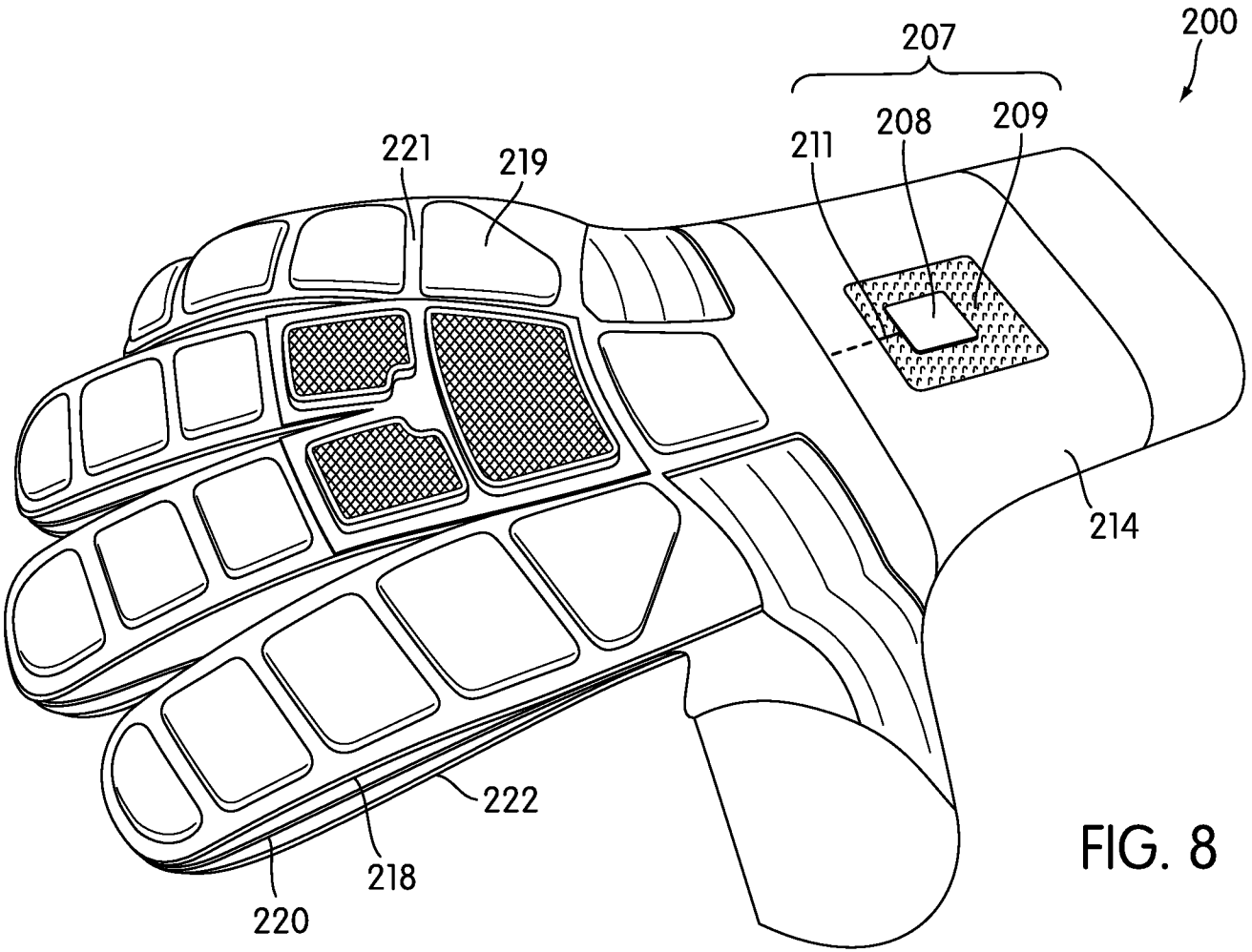
FIG. 8 is an isometric view showing an alternate embodiment of an adjustable glove.
Figure 9:
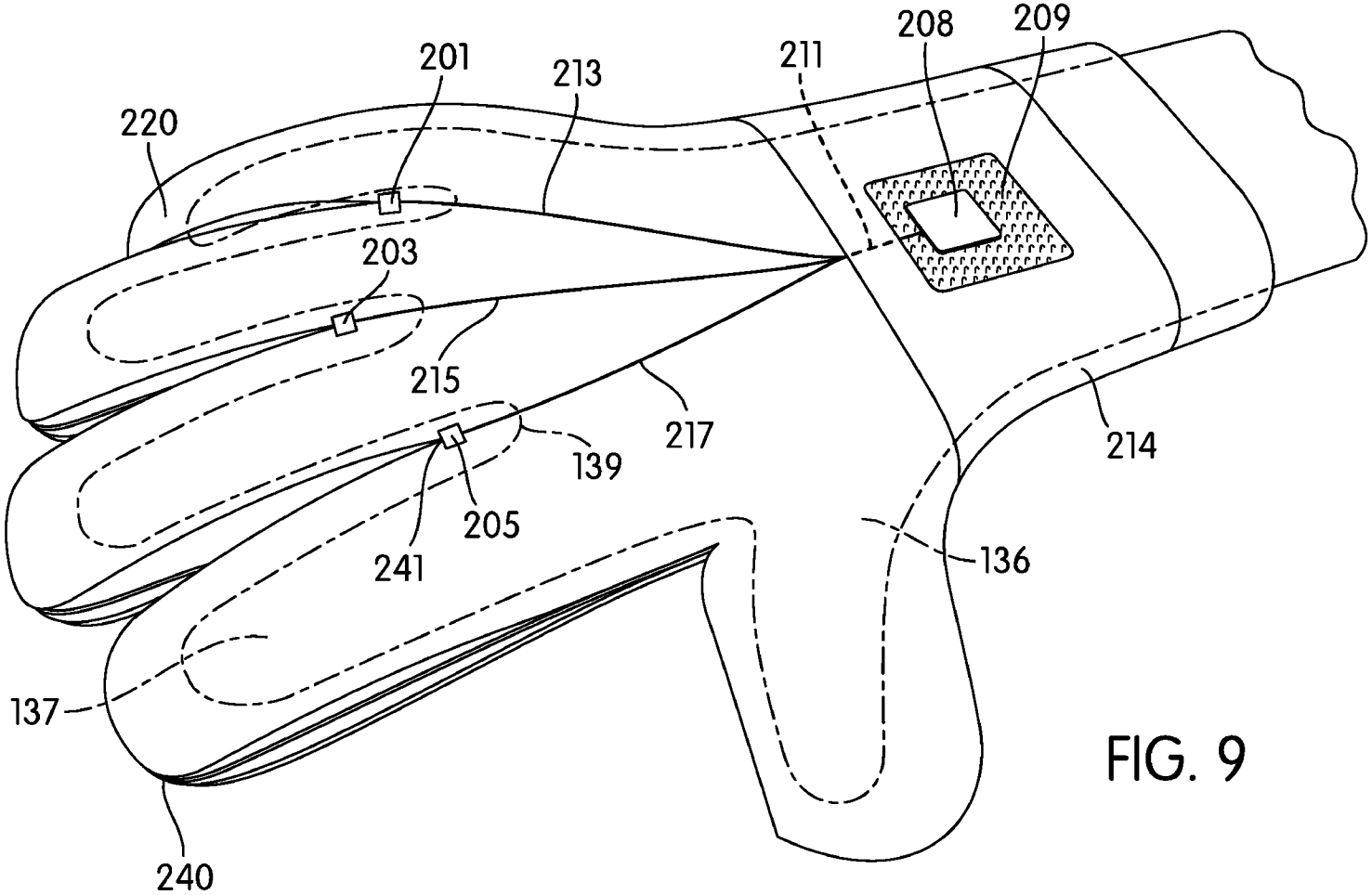
FIG. 9 is a partial isometric view showing the adjustment system of the glove of FIG. 8 and a hand loosely positioned within the glove.
Figure 10:
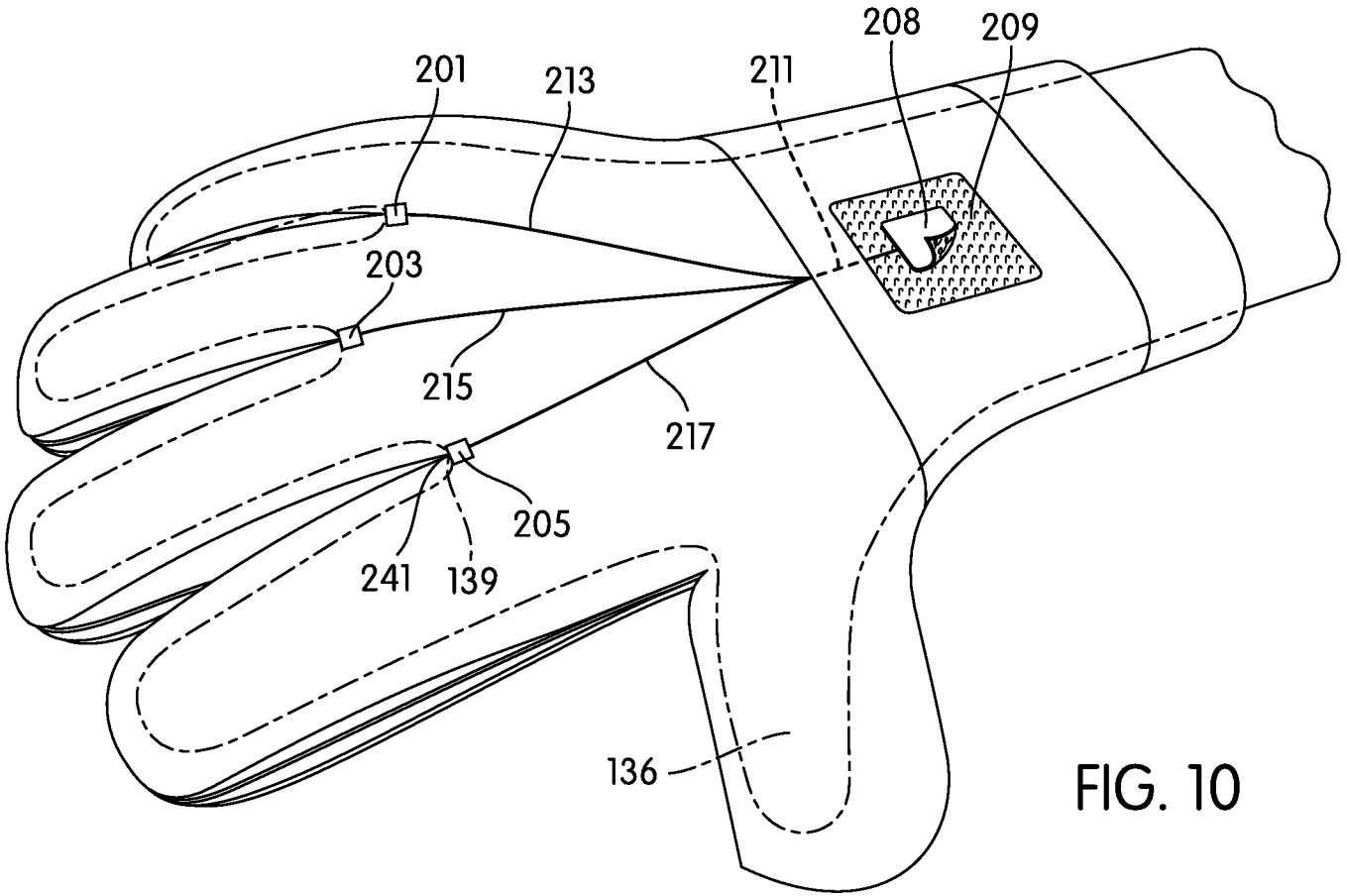
FIG. 10 is a partial isometric view showing a hand being tightly positioned within the glove of FIG. 8 through manipulation of the adjustment system.

Alternate adjustment systems are available to bring web 179 into contact with interior surface 181. In one embodiment, as shown in FIGS. 8-10, a glove 200, similar in most respects with glove 100 as described above, includes a dorsal layer 218, a flexible layer 220, and a palm layer 222. Glove 200 is provided with an adjustment system 207 including a pull tab 208. Pull tab 208 is a portion of a strong but flexible material configured to be removably attached to a surface 209 of dorsal layer 218. In one embodiment, pull tab 208 may be made from a synthetic woven material, such as nylon or polyester, while in other embodiments, pull tab 208 may be made from natural woven materials or natural or synthetic non-woven materials.

Pull tab 208 is configured to be removably attached to dorsal layer 218 or a wrist strap 214 covering a portion of dorsal layer 218. A pull tab attachment surface 209 is provided to secure pull tab 208. In the embodiment shown in FIGS. 8-10, attachment surface 209 comprises one-half of a hook-and-loop attachment system, such as Velcro®, fixedly attached to wrist strap 214. The other half of the hook-and-loop attachment system is provided on an under-surface of pull tab 208, as best shown in FIG. 10. In other embodiments, the attachment system for securing pull tab 208 to attachment surface 209 may include any type of mechanical fastener, such as snaps and buttons.

Adjustment system 207 also includes several cords 211, 213, 215, and 217 fixedly attached to pull tab 208 and extending towards the base of the finger stalls. These cords transfer a pulling motion exerted in pull tab 208 to other portions of glove 200. Cords 211, 213, 215, and 217 are preferably filament-shaped and made from a material having high tensile strength, such as woven natural or synthetic materials, metals, plastics, or combinations of these materials. For example, in one embodiment, cords 211, 213, 215, and 217 may be made from Kevlar®, while in another embodiment, cords 211, 213, 215, and 217 may be made from nylon.

In one embodiment, as shown in FIGS. 9 and 10, a main cord 211 is fixedly attached to pull tab 208 and extends just beyond wrist strap 214. A first cord 213 branches off of main cord 211 and extends to a first attachment area 201 located at the base of the fourth and fifth finger stalls. A first cord 213 is fixedly attached to first attachment area 201 using any method known in the art, such as with an adhesive or by stitching. A second cord 215 branches off of main cord 211 and extends to a second attachment area 203 located at the base of the third and fourth finger stalls. Second cord 215 is fixedly attached to second attachment area 203 using any method known in the art, such as with an adhesive or by stitching. A third cord 217 branches off of main cord 211 and extends to a third attachment area 205 located at the base of the second and third finger stalls. Third cord 217 is fixedly attached to third attachment area 205 using any method known in the art, such as with an adhesive or by stitching. Cords 213, 215, and 217 may be formed separately from and then attached to main cord 211, such as with an adhesive or by stitching. Preferably, however, cords 213, 215, and 217 are co-formed with main cord 211, with main cord 211 being spliced, split, unwoven, or otherwise separated to form cords 213, 215, and 217.

In some embodiments, attachment areas 201, 203, and 205 may be a portion of flexible layer 220. However, attachment areas 201, 203, and 205 preferably include reinforcing patches fixedly attached to flexible layer 220. These reinforcement patches may be made of a strong but flexible material capable of preventing damage to flexible layer 220 when cords 213, 215, and 217 pull on flexible layer 220, as described below.

A user may utilize adjustment system 207 to correct a poor fit, such as shown in FIG. 9, where a finger web 179 is not in contact with an internal surface 241 of glove 200. Pull tab 208 is separated from attachment surface 209, such as by peeling apart a hook-and-loop system using the fingers of the opposite hand. Pull tab 208 is then drawn away from attachment areas 201, 203, and 205, such as by pulling. Cords 211, 213, 215, and 217 transfer this pulling motion to attachment areas 201, 203, and 205. Because cords 211, 213, 215, and 217 are fixedly attached to attachment areas 201, 203, and 205, attachment areas 201, 203, and 205 are also pulled in the same direction as pull tab 208. As attachment areas 201, 203, and 205 are either portions of flexible layer 220 of glove 200 or are fixedly attached to flexible layer 220, flexible layer 220 is also moved in the same direction as pull tab 208. Consequently, interior surface 241 is brought back into contact with finger web 179 by manipulating pull tab 208 until the desired fit is achieved.

Figure 11:
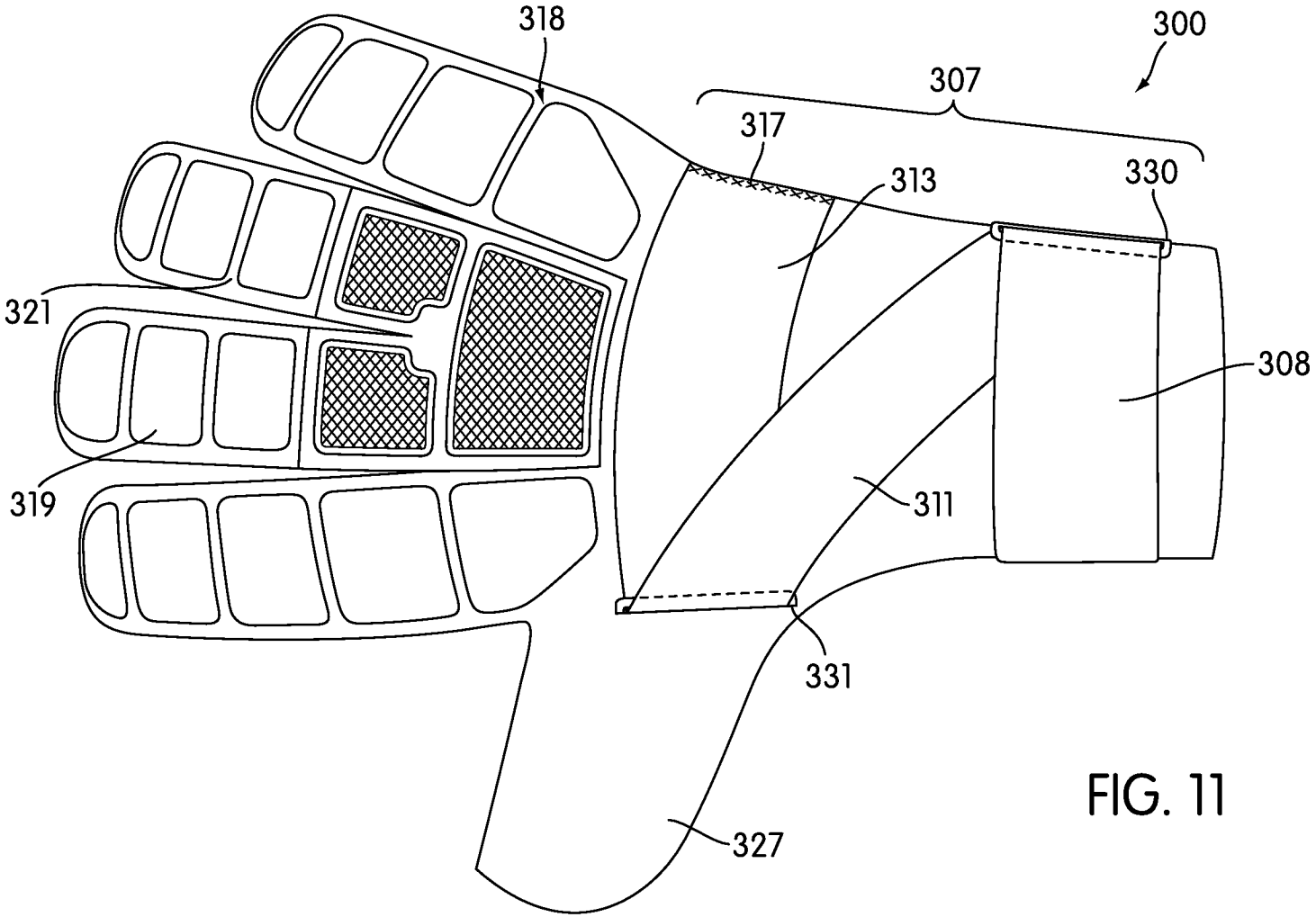
FIG. 11 is a top view of an alternate embodiment showing an adjustable glove.
Figure 12:
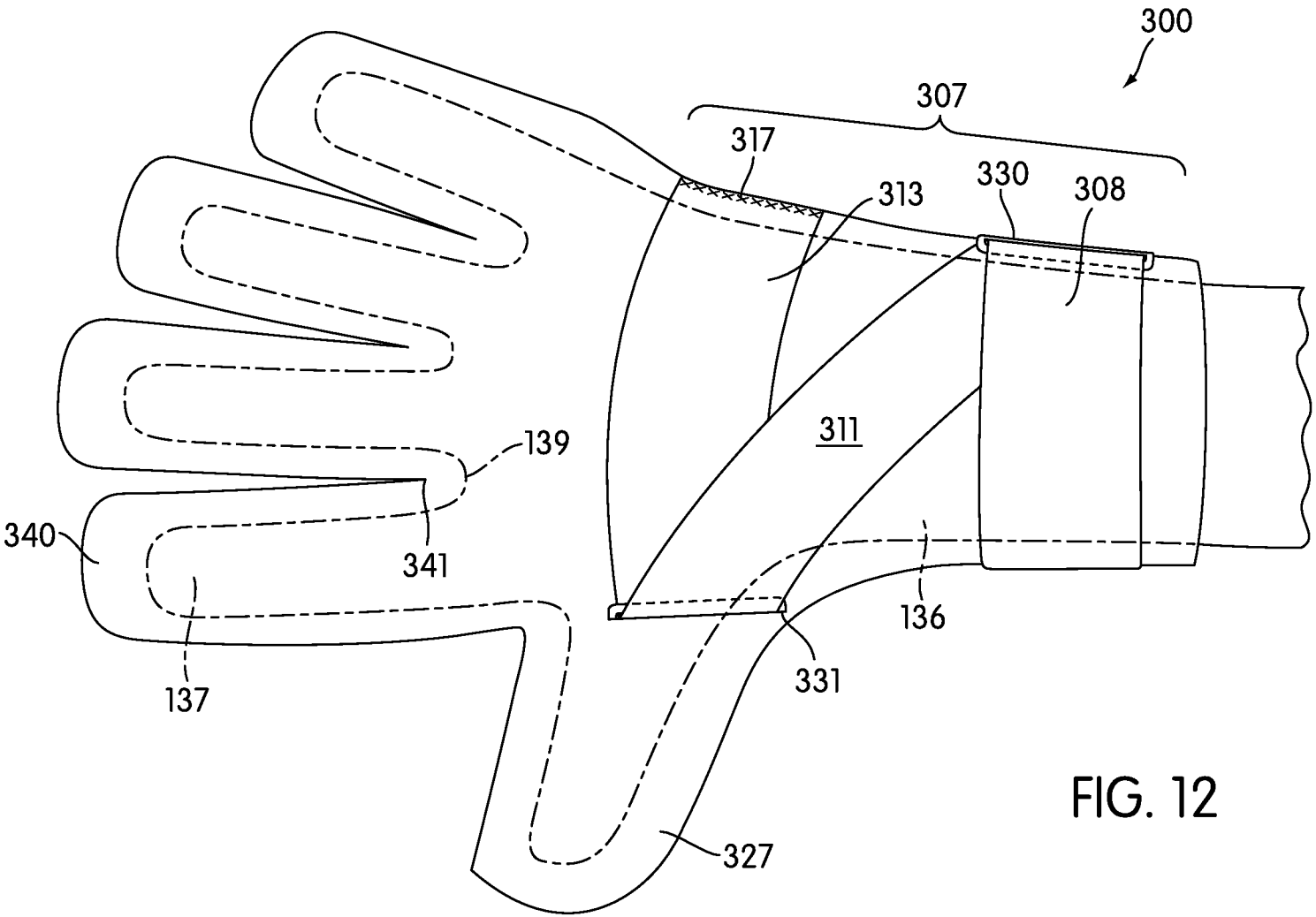
FIG. 12 is a partial top view of the glove of FIG. 11 and a hand loosely positioned within the glove.
Figure 13:
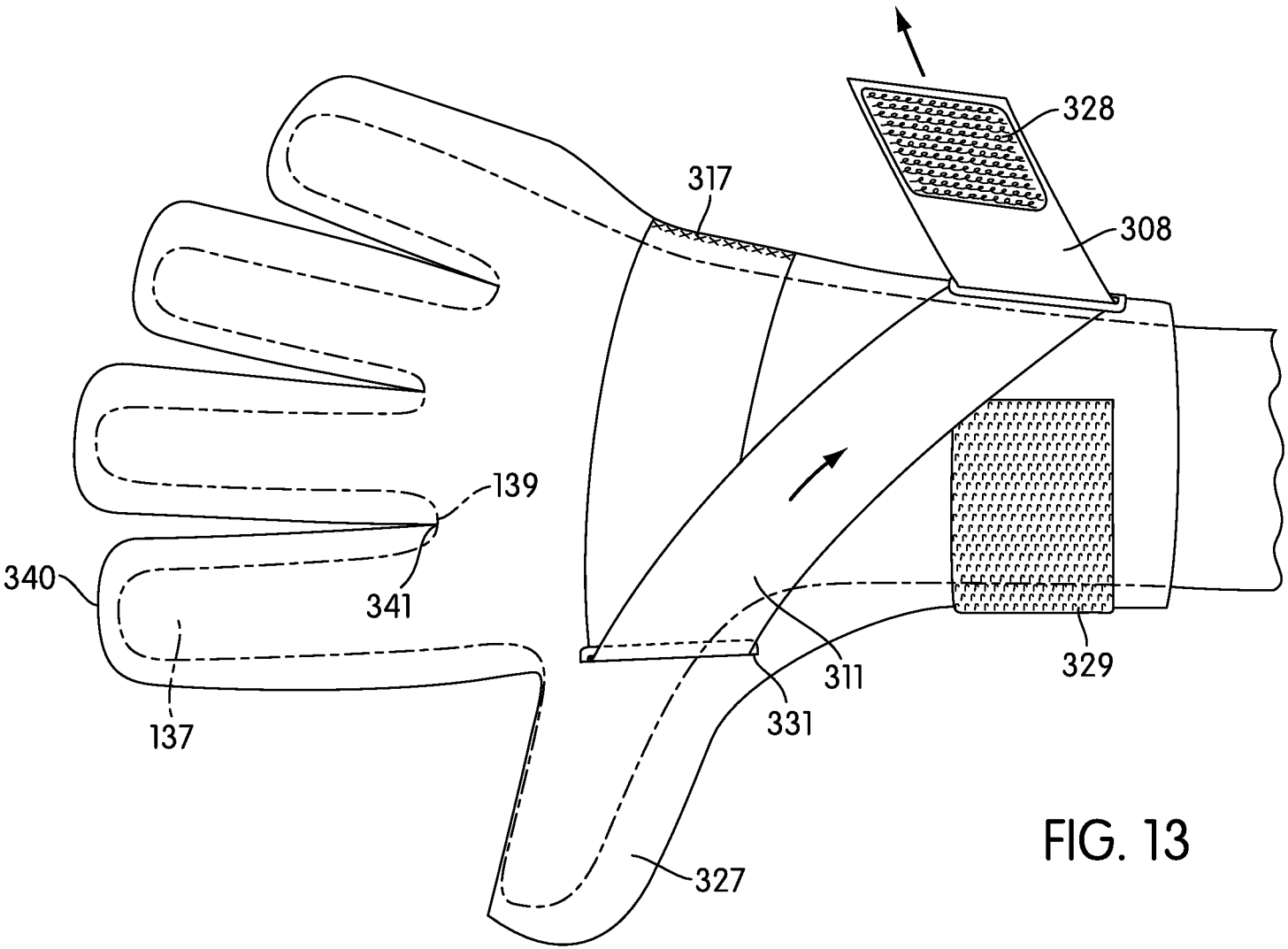
FIG. 13 is a partial top view of the glove of FIG. 11 and a hand being tightly positioned within the glove through manipulation of the adjustment system.

Another embodiment of an adjustment system 307 configured to bring finger web 139 back into contact with an interior surface 341 of a glove 300 is shown in FIGS. 11-13. Glove 300 is similar to gloves 100 and 200 described above. FIG. 11 shows a dorsal side of glove 300, with adjustment system 307 in a closed position. Adjustment system 307 includes three straps 308, 311, and 313 arranged in a zig-zag pattern across glove 300 beneath a portion of a dorsal layer 318. Dorsal layer 318 preferably includes raised portions 319 for cushioning and recessed portions 321 for flexibility. For clarity, dorsal layer 318 is removed in FIGS. 12 and 13, though it will be understood that dorsal layer 318 is preferably included with glove 300.

Preferably straps 308, 311, and 313 are formed from a single portion of a strong and flexible material, such as nylon, cotton, or material-reinforced foam. In one embodiment, as shown in FIGS. 11-13, straps 308, 311, and 313 are threaded though first and second loops 330 and 331 to separate the single portion of material into straps 308, 311, and 313. Thus, while discussed as separate portions, straps 308, 311, and 313 can be manipulated as a single unit to adjust the fit of glove 300. First and second loops 330 and 331 are preferably metal, plastic, or fabric loops fixedly attached to glove 300 using any method known in the art, such as by stitching or with an adhesive. Alternatively, first and second loops 330 and 331 may be co-formed with dorsal layer 318 of glove 300.

Pull tab strap 308 is preferably removably attachable to a wrist area of glove 300. Pull tab strap 308 extends from a free end on a thumb 327 side of glove 300 to and through first loop 330 on the opposite side of the wrist. As shown in FIG. 13, the free end of pull tab strap 308 includes a first attachment mechanism 328 fixedly attached to one side of pull tab strap 308. A corresponding attachment mechanism 329 is fixedly attached to glove 300 so that the free end of pull tab strap 308 may be secured to glove 300. Attachment mechanisms 328 and 329 may be any type of mechanism known in the art, such as snaps, buttons, or press-fitted portions. However, in a preferred embodiment, mechanisms 328 and 329 are a hook-and-loop attachment system.

Second strap 311 extends from first loop 330 to second loop 331. Second loop 331 is positioned at or near the base of thumb portion 327. Third strap 313 extends from second loop 331 to an attachment area 317 where third strap 313 is fixedly attached to glove 300 at or near the base of the fifth (or "pinky") finger. Third strap 313 may be fixedly attached to glove 300 using any method known in the art, such as with stitches (as shown in FIGS. 11-13) or with an adhesive.

Because straps 308, 311, and 313 are essentially a single, inelastic unit threaded through a series of loops 330 and 331, manipulating any one of the straps results in a manipulation of all of straps 308, 311, and 313, such as by manipulating the free end of pull tab strap 308. Such an action may be desirable when a hand 136 inside glove 300 is loosely positioned so that a finger web 179 is not in contact with an interior surface 341 of glove 300, such as is shown in FIG. 12.

As shown in FIG. 13, to manipulate glove 300 into the tightened position with respect to hand 136, pull tab strap 308 is separated from glove 300, such as by disengaging first and second attachment mechanisms 328 and 329. Pull tap strap 308 is then drawn in the direction shown by the arrow, such as by pulling pull tab strap 308 using the opposite hand. Manipulating pull tab strap 308 in this direction increases the length of pull tab strap 308, as a portion of second strap 311 travels in the direction of the second arrow through first loop 330 when pull tab strap 308 is pulled. Because second strap 311 is inelastic, second strap 311 maintains its length by pulling on third strap 313 so that a portion of third strap 313 travels through second loop 331. As third strap 313 is fixedly attached to glove 300, the pulling force exerted on third strap 313 by pull tab strap 308 via second strap 311 is transferred to glove 300. The finger portion of glove 300 is moved towards the wrist so that finger web 179 is once again brought into contact with interior portion 341.

Figure 14:
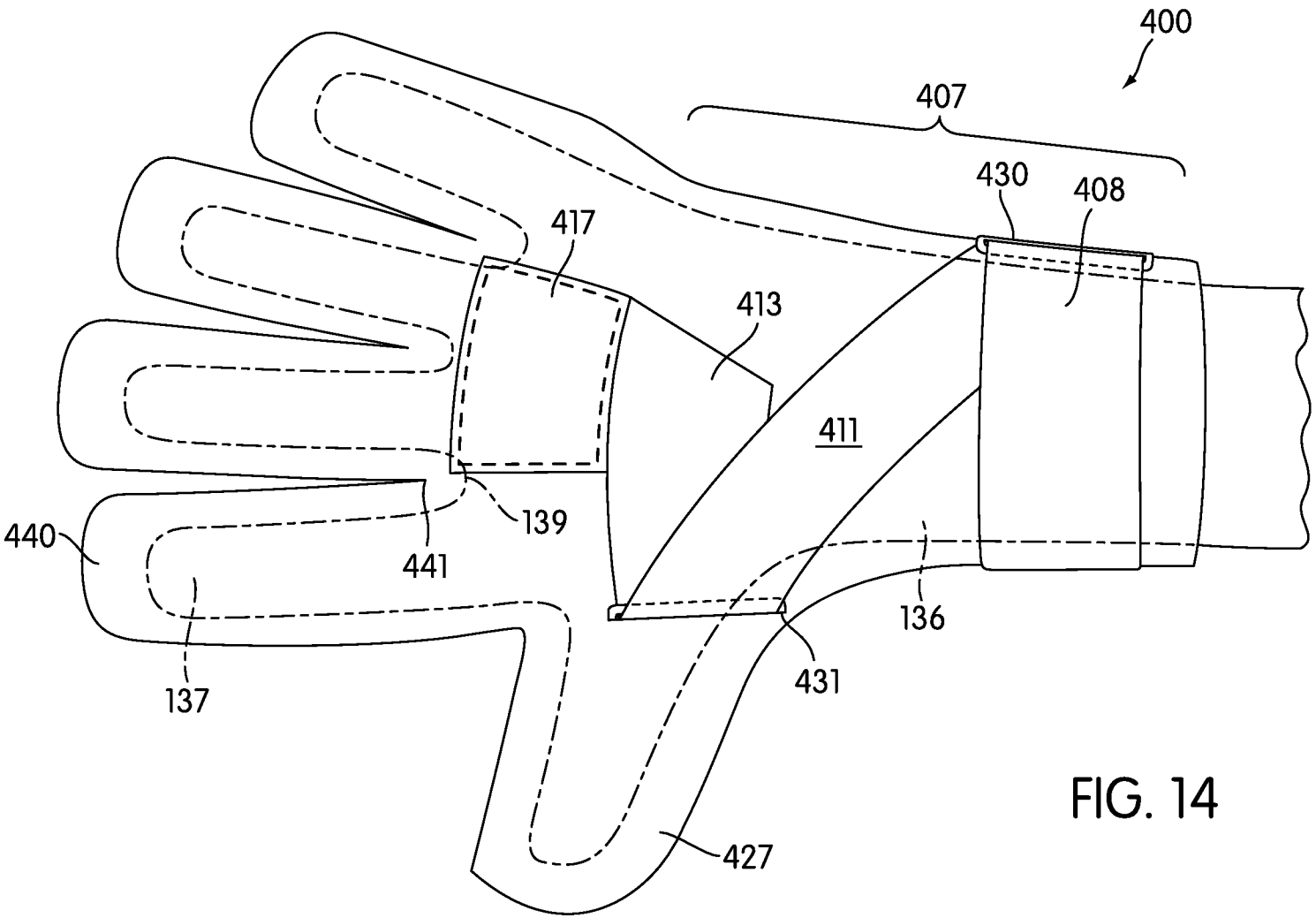
FIG. 14 is a top view a glove with an adjustment system a hand loosely positioned within the glove.
Figure 15:
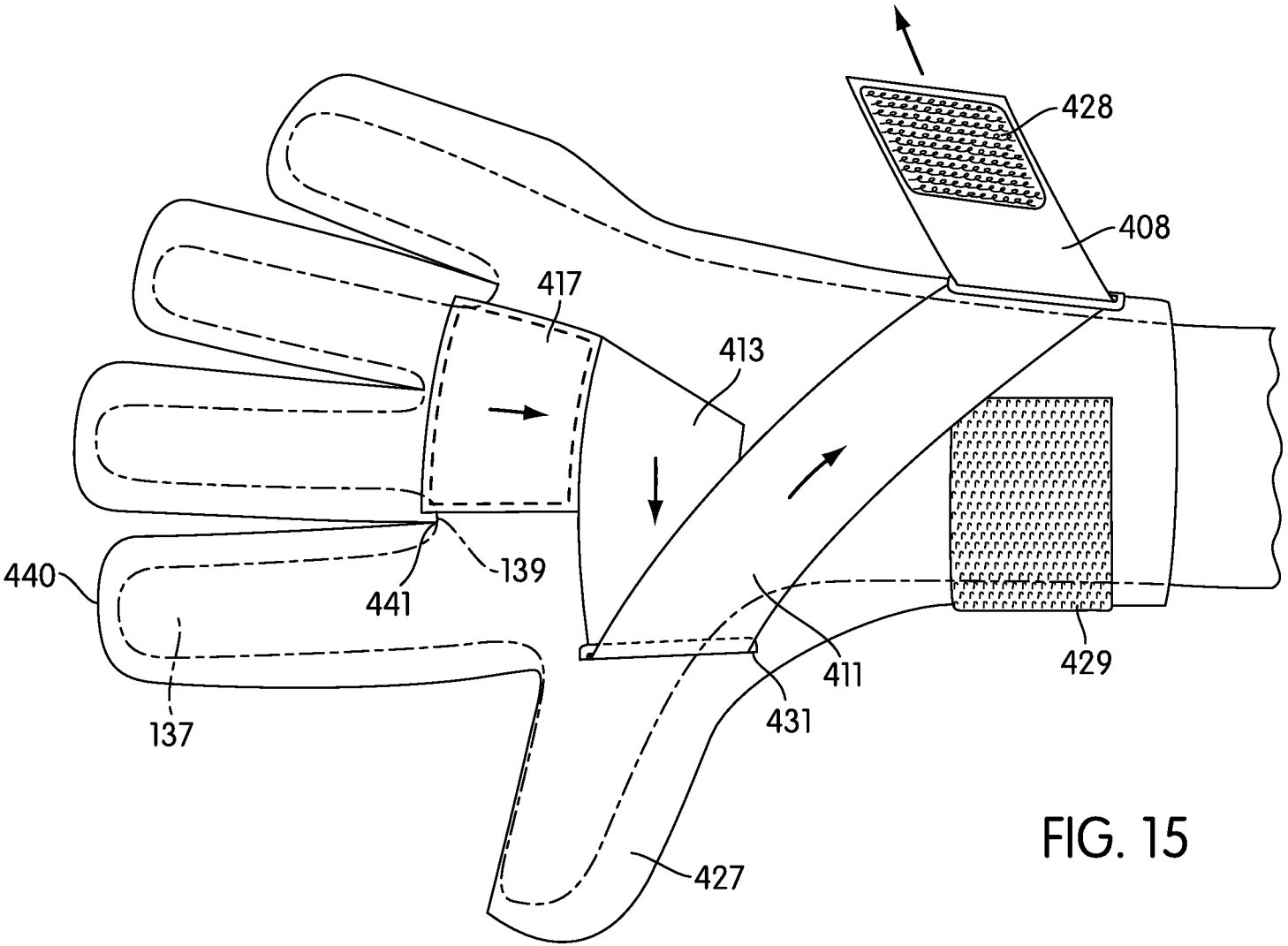
FIG. 15 is a top view of the glove of FIG. 14 and a hand being tightly positioned within the glove through manipulation of the adjustment system.

Another embodiment of an adjustment system 407 for use with a glove 400 is shown in FIGS. 14-15. Glove 400 is similar to glove 300 in that glove 400 utilizes a system of straps, a first strap 408, a second strap 411, and a third strap 413 positioned on glove 400 in a zig-zag pattern. Glove 400 is shown without a dorsal layer such as dorsal layer 318, but could include such a layer over at least a portion of straps 408, 411, and 413. Unlike glove 300, third strap 413 is not connected to a side of glove 400. Instead, third strap 413 terminates at an attachment area 417 positioned near the glove finger portion, i.e., near the finger stalls, of glove 400. In the embodiment shown in FIGS. 14 and 15, attachment area 417 is positioned underneath two fingers. In other embodiments, attachment area 417 may be positioned underneath any or all of the fingers of glove 400 or any combination of fingers.

Attachment area 417 may be any portion of a surface of glove 400. However, as shown in FIGS. 14 and 15, attachment area 417 may be a reinforced portion of glove 400. The reinforcement of attachment area 417 may be any type of reinforcement known in the art, such as by associating additional material with glove 400. The additional material may be associated with glove 400 using any method known in the art, such as stitching, adhering, welding, co-forming, or making a surface of glove 400 with varying thickness, such as by selectively increasing the amount of material when forming a dorsal layer. The additional material may be any type of material known in the art, but in some embodiments may be a panel of frictional material so that attachment area 417 may also be used as a punch surface. In other embodiments, the reinforcement of attachment area 417 may be a panel of other material, such as foam, a woven material, or the like. In other embodiments, the reinforcement of attachment area 417 may include additional layers of an attachment material, such as additional stitching or adhesive.

Similar to strap 308 of glove 300, first strap 408 is removably attachable to a wrist area of glove 400. The attachment of first strap 408 may be achieved using any method known in the art, such as by using a hook-and-loop system, a snap, buttons, hooks, buckles, or similar mechanical fasteners. Second strap 411 may be continuous with first strap 408 and may pass though a first loop 430 positioned on one side of glove 400. First loop 430 may be made from any material known in the art and attached to glove 400, or may be a slit formed in glove 400. First loop 430 allows the strap to be re-oriented so that second strap 411 may extend across glove 400 in a different direction from that of first strap 408. Second strap 411 may then pass though a second loop 431 on an opposite side of glove 400 to first loop 430 so that second strap 411 may be re-oriented into third strap 413, which extends back across glove 400 to attachment area 417. Third strap 413 is preferably fixedly attached to attachment area 417 using any method known in the art, such as by stitching, using an adhesive, welding, or the like.

In one example of the use of the adjustment system, a wearer's hand 136 may be loosely positioned within glove 400 so that the finger webs are not positioned against glove webs. Although any or all of the finger webs and glove webs may be implicated, for clarity and simplification, only one representative finger web 139 and glove web 441 are shown and discussed. Additionally, a fingertip 137 may be positioned uncomfortably far from a glove fingertip 440. To adjust glove so that finger web 139 is positioned in contact with or near glove web 441, a wearer grasps first strap 408 and disassociates first strap 408 from glove 400. The wearer then tugs or pulls on first strap 408, in the direction shown by the arrow. The tugging motion on strap 408 pulls on continuous second strap 411, and second strap 411 moves in the direction indicated by the arrow. As second strap 411 moves, second strap 411 pulls on continuous third strap 413, and third strap 413 moves in the direction indicated by the arrow. Because third strap 413 is attached to attachment area 417, attachment area 417 is pulled in the direction indicated by the arrow. Because attachment area 417 is fixedly attached to glove 400 in the vicinity of the fingers of glove 400, the fingers of glove 400 are pulled toward fingertip 137. The wearer may pull on first strap 408 until the fit of glove 400 reaches a desired position, such as when glove web 441 and finger web 139 are in contact or are positioned near to each other. Once the desired fit has been achieved, first strap 408 is then re-attached to glove 400, such as by pressing a first portion of a hook-and-loop system 428 positioned on strap 408 to a second portion of a hook-and-loop system 429 that is positioned on glove 400 until the two portions 428 and 429 engage.

Figure 16:
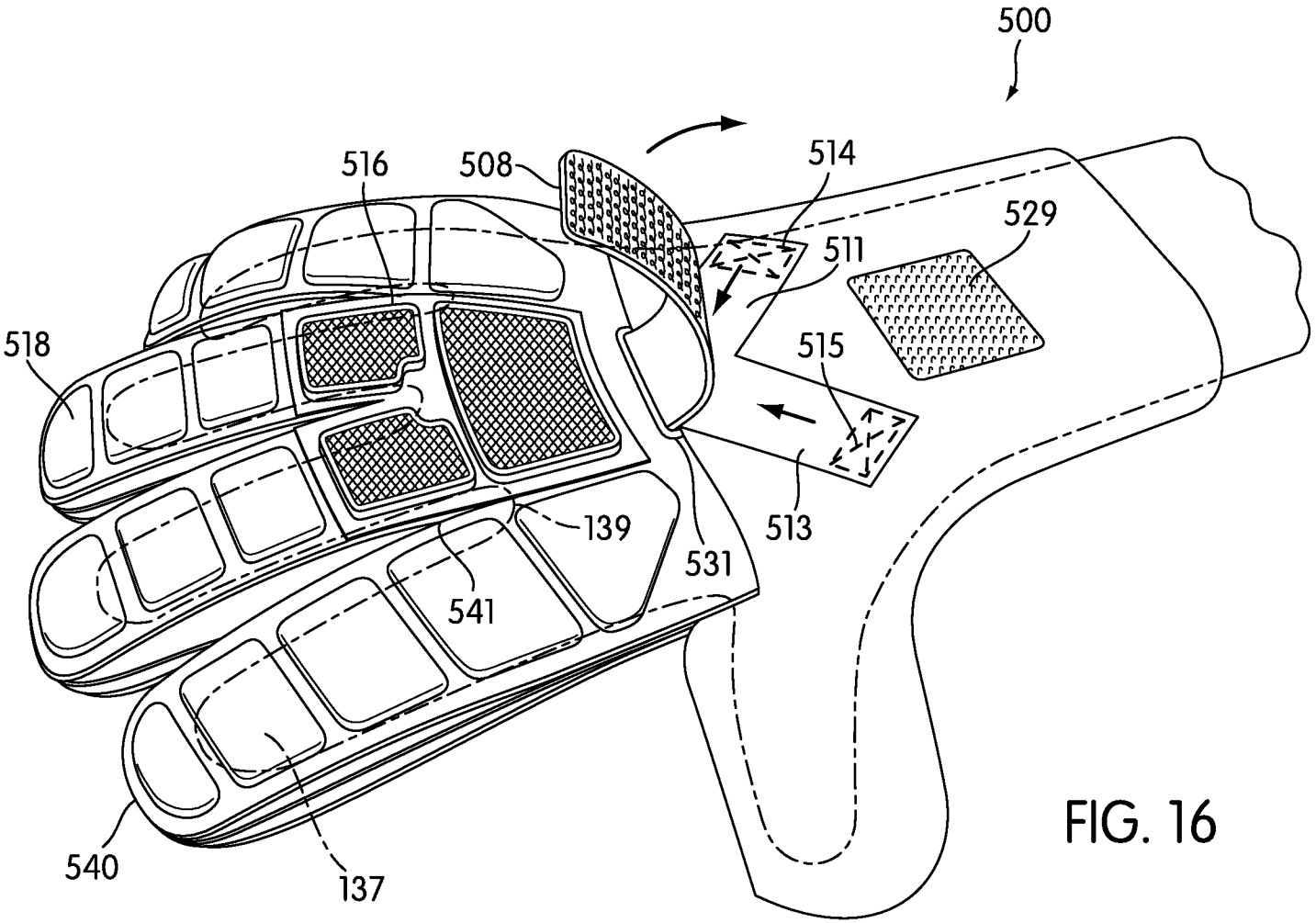
FIG. 16 is a perspective view of another embodiment of a glove with an adjustment system, a hand loosely positioned within the glove, and the manipulation direction of the adjustment system to adjust the position of the hand within the glove.
Figure 17:
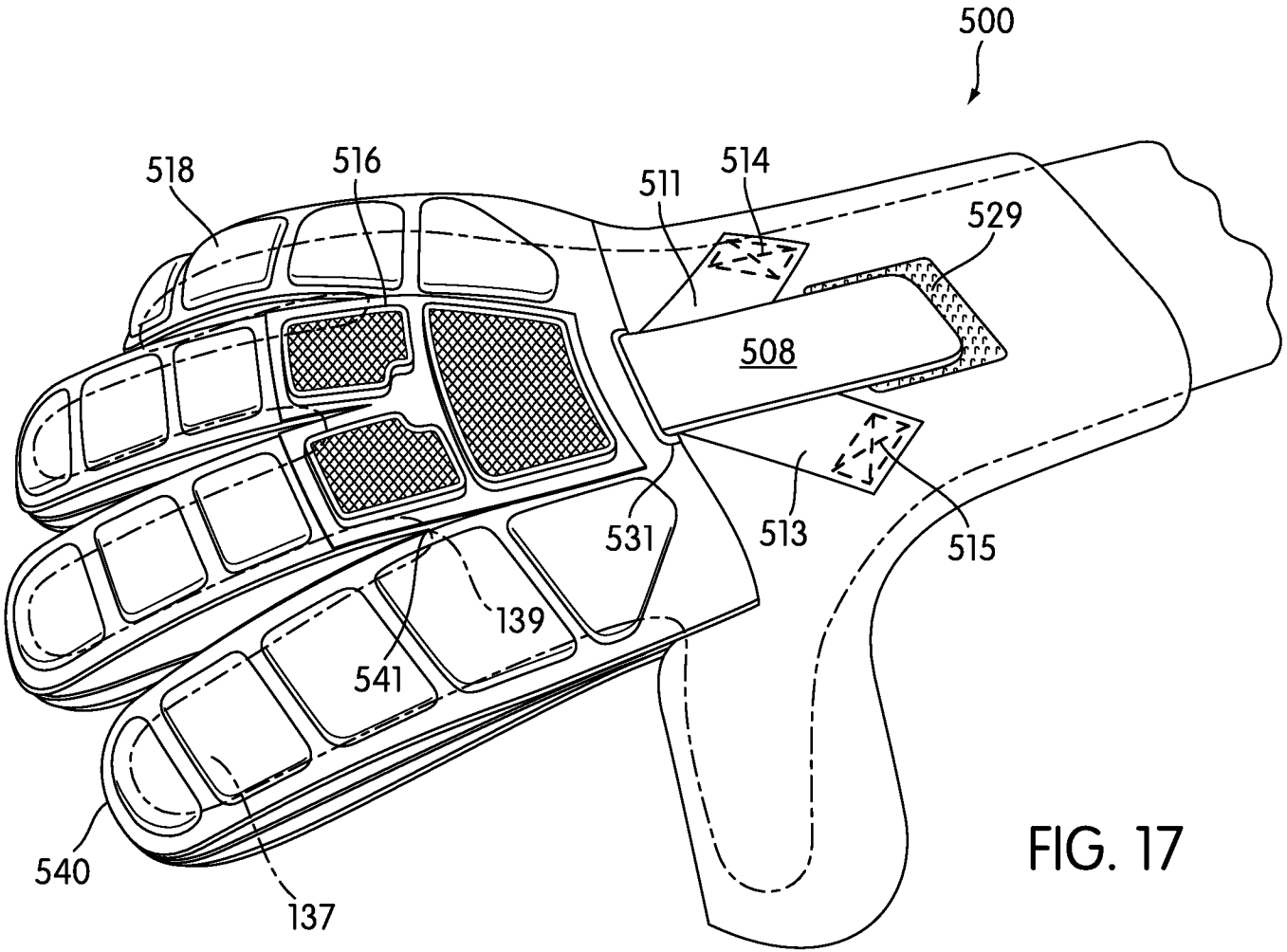
FIG. 17 is a perspective view of the glove of FIG. 16 and a hand tightly positioned within the glove.

FIGS. 16 and 17 show yet another embodiment of a glove 500 having an adjustment system for adjusting the fit of glove 500 on a wearer's hand. Glove 500 is generally similar to any of the gloves 100, 200, 300, and 400 discussed above, although the arrangement of the adjustment system of glove 500 differs from previously discussed embodiments. As shown in FIGS. 16 and 17, the adjustment system generally includes a first strap 508, a second strap 511, and a third strap 513. First strap 508 is removably attachable to a surface of glove 500, while second strap 511 and third strap 513 are fixedly attached to glove 500. In this embodiment, first strap 508 is continuous with second strap 511 and third strap 513, although in other embodiments, first strap 508 may be separated from either or both of second strap 511 and third strap 513 by one or more additional elements, such as connectors.

Second strap 511 and third strap 513 are generally positioned relative to each other so that straps 511 and 513 form a V-shape on the back of glove 500. In the embodiment shown, straps 511 and 513 are continuous with each other, i.e., are formed from a single portion of material. However, in other embodiments, multiple portions of material may be used and attached to each other. Preferably, straps 511 and 513 are fixedly attached to the outermost layer of glove 500. In one embodiment, as shown in FIGS. 16 and 17, straps 511 and 513 are attached to an outer layer of glove 500 that is separate from a dorsal layer 518 that extends from the fingertips to a point near the knuckles. Straps 511 and 513 may be attached to glove 500 using any method known in the art, such as by stitching, with an adhesive, welding, or the like. In the embodiment shown in the figures, additional reinforcing attachments are provided, first reinforcing attachment 514 and second reinforcing attachment 515. Reinforcing attachments 514 and 515 may be any type of reinforcing known in the art, but in the embodiment shown is additional stitching at or near the termini of straps 511 and 513. In some embodiments, straps 511 and 513 may be attached to glove only at reinforcing attachments 514 and 515 while the rest of straps 511 and 513 remain unattached to glove 500.

At or near the apex of the V-shape formed by straps 511 and 513, first strap 508 is associated with straps 511 and 513. At or near this point, a portion of first strap 508 is associated with a loop 531, such as being passed through loop 531 or fixedly or removably attached to loop 531. Loop 531 may be made of any material known in the art, such as metals, plastics, or the like. Loop 531 is associated with dorsal layer 518 of glove 500, such as by being fixedly attached to dorsal layer 518, for example, by being stitched, glued, or otherwise affixed to glove 500. Alternatively, loop 531 may be provided by forming an opening in a dorsal layer 518 of glove. Once first strap 508 passes through loop 531, first strap 508 may be folded over so that first strap 508 may be removably attached to an attachment surface 529 on glove 500. Attachment surface 529 may be any type of attachment mechanism known in the art, such as a portion of a hook-and-loop mechanism, a snap interface, a button or buttonhole, a clip, a hook, a buckle, or the like.

In FIG. 16, a wearer's hand is loosely positioned within glove 500, so that a finger web 139 is not in contact with or positioned close to a glove web 541. Only finger web 139 and glove web 541 are discussed herein, although any or all of the finger webs and glove webs may be similarly disposed. Similarly, a fingertip 137 may be uncomfortably far from a glove fingertip 540. To adjust glove 500 for a tighter fit across the back of the hand and through the fingers, first strap 508 is grasped, such as by the wearer, and pulled or tugged in the direction indicated by the arrow. This tugging motion is translated to second strap 511 and third strap 513, which are attached to the surface of glove 500. Forces, in the direction shown by the arrows, are transferred through straps 511 and 513 to glove 500, which causes the width of glove 500 to tighten on the hand. Simultaneously, first strap 508 pulls or tugs on loop 531, causing loop 531 to move in the same direction as first strap 508. Because loop 531 is fixedly attached to dorsal layer 518, this force pulls the finger portion of glove 500 toward fingertip 137, as shown in FIG. 17.

In some embodiments, first strap 508 may be configured so that the amount of first strap 508 that may slide through loop 531 is limited, such as by stops or attaching first strap to loop 531 in a pocket of material formed along the length of first strap 508. Once the limit of the sliding movement has been reached, first strap 508 may be able to pull with greater force on loop 531, and consequently, on the finger portion of glove 500, thereby facilitating the adjustment of the finger portion of glove 500. In some embodiments, first strap 508 may be fixedly attached to loop 531 so that little or no relative motion of first strap 508 and loop 531 is achievable.

In FIG. 17, glove 500 is now in a tightened position. Finger web 139 is now positioned in contact with or close to a glove web 541. Similarly, fingertip 137 is now positioned closer to or in contact with glove fingertip 540. Once the desired fit has been achieved, strap 508 is attached to glove 500, by folding strap 508 to attachment surface 529 and attaching strap 508 to attachment surface 529.

Figure 4:
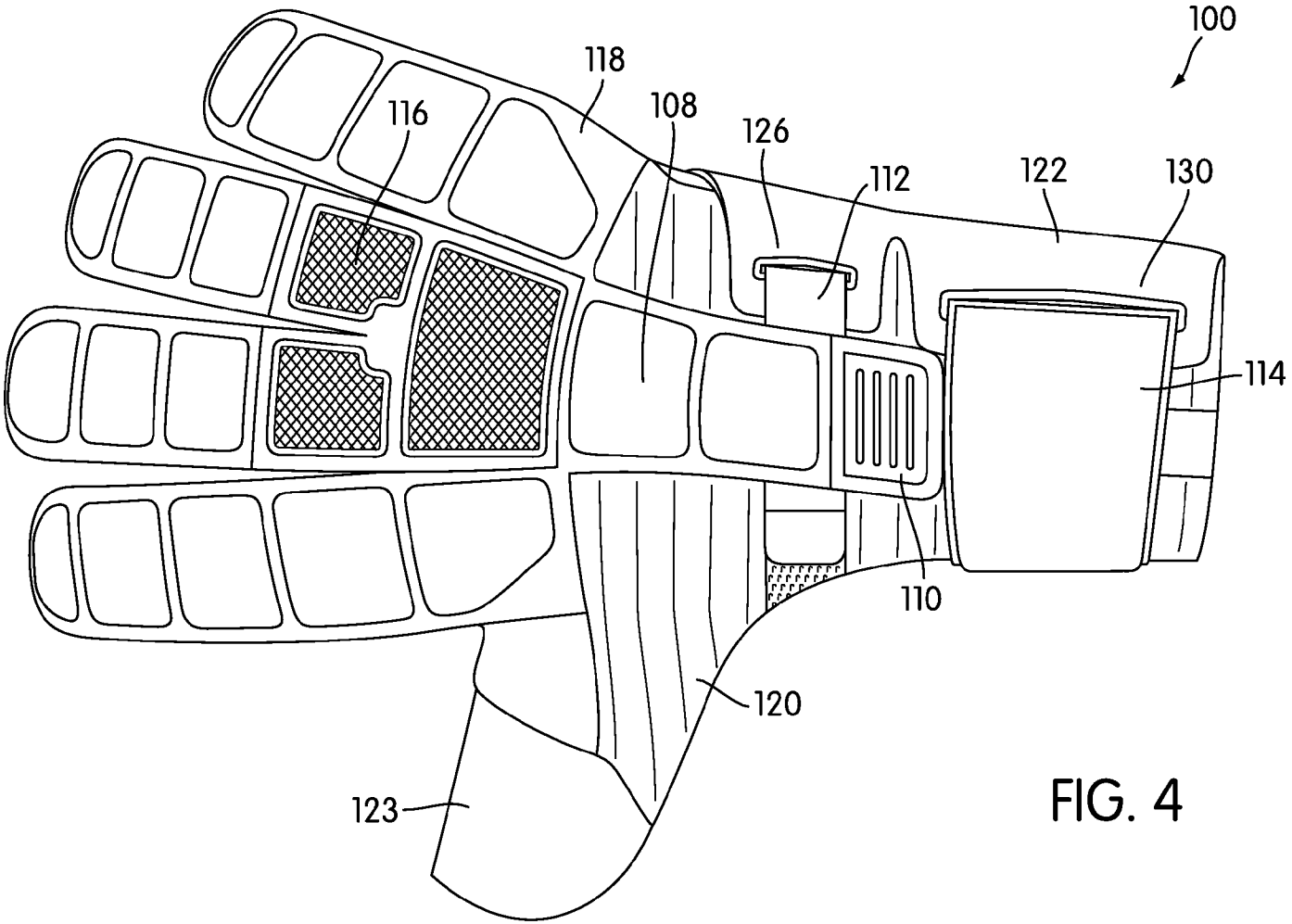
FIG. 4 is a top view of the glove of FIG. 1 showing the adjustment straps in an alternate configuration.

Width adjustment strap 112 allows the wearer to alter the fit of glove 100 to conform main body 102 to the wearer's hand. Width adjustment strap 112 is preferably formed from an elongated portion of inelastic woven material stitched or otherwise affixed to flexible layer 120. As shown in FIG. 3, width adjustment strap 112 extends from main portion 102 on medial side 152 of glove 100, passes through width adjustment loops 126 and 146, and is bent back across glove 100 toward medial side 152 to be secured to an outer surface of flexible layer 120, as shown in FIGS. 1, 4, and 6.

Width adjustment loop 126 and second width adjustment loop 146 are formed, respectively, on palm layer 122 and flexible layer 120 to accommodate and work in concert with width adjustment strap 112 to enable the adjustability of fit of glove 100. Width adjustment loop 126 and second width adjustment loop 146 are preferably positioned on lateral side 150 of glove 100. Width adjustment loop 126 is configured with a centrally located opening to allow width adjustment strap 112 to be passed through width adjustment loop 126.

Preferably, width adjustment loop 126 is formed integrally with palm layer 122. However, in other embodiments, width adjustment loop 126 may be formed separately from the remainder of palm layer 122 and affixed to palm layer 122 using any method known in the art, such as by stitching or with an adhesive. Preferably, width adjustment loop 126 is made from the same material as the remainder of palm layer 122. However, in other embodiments, width adjustment loop 126 may be made from or lined with a different, more rigid material to prevent deformation of width adjustment loop 126 over time. For example, width adjustment loop 126 may be made from a metal or thermoplastic material or include a ring made from a metal or thermoplastic material surrounding the opening formed in width adjustment loop 126.

Second width adjustment loop 146 is also configured with a centrally located opening to allow width adjustment strap 112 to be passed through second width adjustment loop 146. Second width adjustment loop 146 is configured to mirror or substantially mirror the size and shape of width adjustment loop 126. As shown in FIG. 3, second width adjustment loop 146 is aligned with and preferably attached to width adjustment loop 126. Preferably, second width adjustment loop 146 is formed integrally with flexible layer 120. However, in other embodiments, second width adjustment loop 146 may be formed separately from the remainder of flexible layer 120 and affixed to flexible layer 120 using any method known in the art, such as by stitching or with an adhesive. Preferably, second width adjustment loop 146 is made from the same material as the remainder of flexible layer 120. However, in other embodiments, second width adjustment loop 146 may be made from or lined with a different, more rigid material to prevent deformation of second width adjustment loop 146 over time. For example, second width adjustment loop 146 may be made from a metal or thermoplastic material or include a ring made from a metal or thermoplastic material surrounding the opening formed in second width adjustment loop 146.

Width adjustment strap 112 is pulled toward medial side 152 to adjust the fit of glove 100 on the wearer's hand. For a loose fit, width adjustment strap 112 is pulled only partially toward medial side 152. To tighten the fit, width adjustment strap 112 is pulled close to medial side 152. As width adjustment strap 112 is passed through loop 126 and loop 146, pulling width adjustment strap 112 pulls loops 126 and 146, providing tension to palm layer 122 and flexible layer 120.

Width adjustment strap 112 preferably includes an attachment mechanism so that width adjustment strap 112 may be secured to flexible layer 120 once the desired fit is achieved. Preferably, the attachment mechanism is a hook-and-loop mechanism. As shown in FIGS. 2, 3, and 7 a first part 124 of the hook-and-loop mechanism is affixed to width adjustment strap 112 using any method known in the art, such as by stitching or with an adhesive. A second part 125 of the hook-and-loop mechanism is affixed to a medial side 152 of flexible layer 120 using any method known in the art, such as by stitching or with an adhesive. Alternatively, second part 125 of the hook-and-loop mechanism may be flexible layer 120 itself. First part 124 and second part 125 may be engaged by pressing the two parts together. Similarly, first part 124 and second part 125 may be disengaged by peeling the two parts apart.

Width adjustment strap 112 may be used to help secure pull tab 108 in position. As shown in FIG. 1, width adjustment strap 112 may be secured to flexible layer 120 by passing width adjustment strap 112 over pull tab 108. This arrangement helps to prevent pull tab 108 from being accidentally dislodged or from peeling up over time as the securing mechanism of pull tab 108 loses efficacy. Alternatively, as shown in FIG. 4, width adjustment strap 112 may be secured to flexible layer 120 by passing width adjustment strap 112 underneath pull tab 108. This allows a wearer to more rapidly utilize pull tab 108 to reposition finger portion 104 during play.

Wrist adjustment strap 114 allows the wearer to alter the fit of glove 100 around the wearer's wrist. Similar to width adjustment strap 112, wrist adjustment strap 114 is preferably formed from an elongated portion of inelastic woven material stitched or otherwise affixed to flexible layer 120. For added protection of the wrist, however, wrist adjustment strap 114 also preferably includes a cushioning material similar to the material used for dorsal layer 118 and palm layer 122, such as latex foam.

As shown in FIG. 3, wrist adjustment strap 114 extends from wrist portion 106 on medial side 152 of glove 100, passes through wrist adjustment loops 130 and 148, and is bent across glove 100 toward medial side 152 to be secured to an outer surface of flexible layer 120, as shown in FIGS. 1, 4, and 6.

Wrist adjustment loop 130 and second wrist adjustment loop 148 are formed, respectively, on palm layer 122 and flexible layer 120 to accommodate and work in concert with wrist adjustment strap 114 to enable the adjustability of fit of glove 100. Preferably loops 130 and 148 extend from lateral side 150 of glove 100. Similar to width adjustment loop 126, wrist adjustment loop 130 is configured with a centrally located opening to allow wrist adjustment strap 114 to be passed through wrist adjustment loop 130. Preferably, wrist adjustment loop 130 is formed integrally with palm layer 122. However, in other embodiments, wrist adjustment loop 130 may be formed separately from the remainder of palm layer 122 and affixed to palm layer 122 using any method known in the art, such as by stitching or with an adhesive. Preferably, wrist adjustment loop 130 is made from the same material as the remainder of palm layer 122. However, in other embodiments, wrist adjustment loop 130 may be made from or lined with a different, more rigid material to prevent deformation of wrist adjustment loop 130 over time. For example, wrist adjustment loop 130 may be made from a metal or thermoplastic material or include a ring made from a metal or thermoplastic material surrounding the opening formed in wrist adjustment loop 130.

Similarly, second wrist adjustment loop 148 is configured with a centrally located opening to allow wrist adjustment strap 114 to be passed through second wrist adjustment loop 148. Second width adjustment loop 148 is configured to mirror or substantially mirror the size and shape of width adjustment loop 130. As shown in FIG. 3, second width adjustment loop 148 is aligned with and preferably attached to width adjustment loop 130. Preferably, second width adjustment loop 148 is formed integrally with flexible layer 120. However, in other embodiments, second width adjustment loop 148 may be formed separately from the remainder of flexible layer 120 and affixed to flexible layer 120 using any method known in the art, such as by stitching or with an adhesive. Preferably, second width adjustment loop 148 is made from the same material as the remainder of flexible layer 120. However, in other embodiments, second wrist adjustment loop 148 may be made from or lined with a different, more rigid material to prevent deformation of second wrist adjustment loop 148 over time. For example, second wrist adjustment loop 148 may be made from a metal or thermoplastic material or include a ring made from a metal or thermoplastic material surrounding the opening formed in second wrist adjustment loop 148.

Wrist adjustment strap 114 is pulled toward medial side 152 to adjust the fit of glove 100 on the wearer's hand. For a loose fit, wrist adjustment strap 114 is pulled only partially toward medial side 152. To tighten the fit, wrist adjustment strap 114 is pulled close to medial side 152. As wrist adjustment strap 114 is passed through loop 130 and loop 148, pulling wrist adjustment strap 114 pulls loops 126 and 146, providing tension to palm layer 122 and flexible layer 120.

Wrist adjustment strap 114 preferably includes an attachment mechanism so that wrist adjustment strap 114 may be secured to flexible layer 120 once the desired fit is achieved. Preferably, the attachment mechanism is a hook-and-loop mechanism. As shown in FIGS. 2, 3, and 7 a first part 128 of the hook-and-loop mechanism is affixed to wrist adjustment strap 114 using any method known in the art, such as by stitching or with an adhesive. A second part 129 of the hook-and-loop mechanism is affixed to a medial side 152 of flexible layer 120 using any method known in the art, such as by stitching or with an adhesive. Alternatively, second part 129 of the hook-and-loop mechanism may be flexible layer 120 itself. First part 128 and second part 129 may be engaged by pressing the two parts together. Similarly, first part 128 and second part 129 may be disengaged by peeling the two parts apart.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A glove configured to receive a hand having a palm side, a dorsal side, fingers, and a wrist, the glove comprising:

a palm layer sized and shaped to substantially cover the palm side of the palm and fingers of the wearer's hand;

a first layer and a second layer both attached to the palm layer along a periphery of a finger stall and both configured to be disposed on a dorsal side of a wearer's hand, wherein the finger stall is formed by the palm layer, the first layer, and the second layer, the finger stall being configured to receive at least one of the wearer's index finger, middle finger, ring finger, and pinky finger;

one of the first layer and the second layer is protective and the other of the first layer and the second layer is flexible;

one of the first layer and the second layer is substantially shorter than the other of the first layer and the second layer;

and an adjustment system attached to one of the first layer and the second layer and configured to reposition the finger stall on the hand.

2. The glove according to claim 1, wherein the adjustment system comprises a pull tab extending from a free end of one of the first layer and the second layer and configured to extend to the wrist of the wearer's hand.

3. The glove according to claim 2, wherein the first layer is flexible and extends from a fingertip of the finger stall to a glove wrist portion and the second layer is flexible and extends from the fingertip of the finger stall to a knuckle region of the glove and wherein the pull tab extends from a free end of the second layer and is configured to be removably attached to the first layer.

4. The glove according to claim 1, wherein a pull tab is connected to an attachment area at a base of the finger stall.

5. The glove according to claim 4, wherein a cord connects the pull tab to the attachment area.

6. The glove according to claim 4, wherein the second layer is configured to be disposed between a wearer's hand and the palm layer.

7. The glove according to claim 1, wherein the adjustment system comprises a pull strap, wherein a first end of the pull strap is associated with the glove at or near the finger stall and a second end of the pull strap is removably attachable to the glove.

8. A glove configured to receive a hand having a palm side, a dorsal side, fingers, and a wrist, the glove comprising:

a palm layer sized and shaped to substantially cover the palm side of the palm and fingers of the wearer's hand;

a dorsal layer attached to the palm layer along a periphery of the palm layer in a glove finger portion, wherein the glove finger portion includes at least one finger stall formed by the palm layer and the dorsal layer, the at least one finger stall being configured to receive at least one of the wearer's index finger, middle finger, ring finger, and pinky finger;

the dorsal layer sized and shaped to form at least a portion of the glove finger portion, the dorsal layer having a medial side and a lateral side that is opposite the medial side;

an adjustment system attached to the dorsal layer and configured to reposition the glove finger portion on the hand; and wherein the adjustment system includes a pull strap extending from and directly attached to an attachment area disposed on the lateral side of the dorsal layer proximate a pinky finger of the glove finger portion to and through a first loop disposed on the medial side of the dorsal layer proximate a thumb portion of the glove finger portion and to and through a second loop disposed on the lateral side of the dorsal layer to form a zig-zag pattern on the glove.

9. The glove according to claim 8, wherein the second loop is disposed proximate a glove wrist portion.

10. The glove according to claim 7, further comprising a second strap and a third strap, wherein the second strap and the third strap are arranged into a V-shape on the glove, and wherein the first end of the pull strap is associated with the second strap and the third strap at or near an apex of the V-shape, wherein the pull strap, the second strap, and the third strap are integrated and wherein the first layer terminates at a free end disposed proximate a knuckle region of the glove and the pull strap extends from the free end of the first layer.

11. The glove according to claim 8, wherein a free end of the pull strap is configured to be removably attached to a glove wrist portion of the dorsal layer.

12. The glove according to claim 8, wherein the straps are configured so that when the pull strap is pulled, both the glove finger portion and a width of the glove are adjusted.

13. The glove according to claim 1, wherein the first layer terminates at a free end disposed proximate a knuckle region of the glove.

14. The glove according to claim 13, a pull tab extends from the free end of the first layer.

15. The glove according to claim 1, further comprising a punch panel having a resilient surface disposed on one of the first layer and second layer proximate a knuckle region of the glove.

16. The glove according to claim 15, further comprising a width adjustment strap including a first end fixedly attached to a first side of the glove between the glove finger portion and a glove wrist portion and a second end removably attachable to the glove.

17. The glove according to claim 1, further comprising a wrist adjustment strap;

the wrist adjustment strap having a first end fixedly attached to a first side of the glove in a wrist portion of the glove and a second end removably attachable to the wrist portion of the glove; and wherein the wrist adjustment strap cinches the glove to the wrist when pulled.

18. An adjustable glove configured to receive a hand having a palm side, a dorsal side, fingers, and a wrist, the adjustable glove comprising: a first layer sized and shaped to substantially cover the palm side of the palm and fingers of the wearer's hand; a second layer connected to the first layer, the second layer having a medial side and a lateral side that is opposite the medial side; the second layer sized and shaped to substantially cover at least the fingers of the dorsal side of the wearer's hand, the second layer having a medial side and a lateral side that is opposite the medial side; the second layer being attached to the first layer along a periphery in a finger portion and terminating in a free end that extends from the medial side to the lateral side, wherein the free end is proximate a knuckle region of the glove; and a pull tab extending from the free end of the second layer, wherein pulling the pull tab toward the wrist positions a web of the hand against an inside surface of the glove.

19. The adjustable glove according to claim 18, further comprising:

a third layer connected to and positioned between the first layer and the second layer;

a width adjustment strap connected to a first side of the third layer;

the width adjustment strap being removably attachable to the third layer; and wherein the width adjustment strap cinches the glove to the hand.

20. The glove according to claim 18, further comprising a wrist adjustment strap;

the wrist adjustment strap having a first end fixedly attached to a first side of the glove in a wrist portion of the glove and a second end removably attachable to the wrist portion of the glove; and wherein the wrist adjustment strap cinches the glove to the wrist when pulled.

21. A glove configured to receive a hand having a palm side, a dorsal side, fingers, and a wrist, the glove comprising:

a palm layer sized and shaped to substantially cover the palm side of the hand, the palm layer having a palm portion configured to substantially cover a palm area of the wearer's hand and a glove finger portion configured to substantially cover the palm side of the wearer's fingers, wherein the glove finger portion has a fingertip region that is distal to the palm portion;

a first layer and a second layer both attached to the palm layer at the fingertip region of the glove finger portion of the palm layer and both configured to be disposed on a dorsal side of a wearer's hand, wherein a finger stall is formed in the glove finger portion by the palm layer, the first layer, and the second layer, the finger stall being configured to receive at least one of the wearer's index finger, middle finger, ring finger, and pinky finger;

one of the first layer and the second layer is protective and the other of the first layer and the second layer is flexible;

one of the first layer and the second layer is substantially shorter than the other of the first layer and the second layer;

the first layer being a single, unitary piece sized and shaped to cover at least four of the fingers and knuckles of the wearer's hand;

the second layer being a single, unitary piece sized and shaped to cover at least four of the fingers and knuckles of the wearer's hand; and an adjustment system attached to one of the first layer and the second layer and configured to reposition the finger stall on the wearer's hand.

* * * * *